US012296279B1

(12) United States Patent
Sadigursky et al.

(10) Patent No.: US 12,296,279 B1
(45) Date of Patent: May 13, 2025

(54) DEVICES AND KITS FOR PROPELLING STRING AND METHODS OF USE THEREOF

(71) Applicant: NXTGEN TOYS LLC, Tempe, AZ (US)

(72) Inventors: Benzion Sadigursky, Tempe, AZ (US); Ross Barash, Tempe, AZ (US); Michael Sadigursky, Titusville, FL (US)

(73) Assignee: NXTGEN TOYS LLC, Tempe, AZ (US)

( * ) Notice: Subject to any disclaimer, the term of this patent is extended or adjusted under 35 U.S.C. 154(b) by 0 days.

(21) Appl. No.: 18/792,749

(22) Filed: Aug. 2, 2024

Related U.S. Application Data

(63) Continuation of application No. 18/442,179, filed on Feb. 15, 2024, now Pat. No. 12,053,711.

(60) Provisional application No. 63/597,947, filed on Nov. 10, 2023.

(51) Int. Cl.
*A63H 29/20* (2006.01)
*A63H 33/22* (2006.01)

(52) U.S. Cl.
CPC ..... *A63H 29/20* (2013.01); *A63H 33/22* (2013.01)

(58) Field of Classification Search
CPC ..... A63H 33/00; A63H 33/18; A63H 33/22; A63H 29/20; A63H 29/22; A63H 1/24; F41B 4/00; F41B 7/025; Y10S 273/24
USPC ..... 446/236, 242; 124/78
See application file for complete search history.

(56) References Cited

U.S. PATENT DOCUMENTS 3,398,949 A 8/1968 Young
3,406,967 A 10/1968 Young
3,902,722 A 9/1975 Skillern
4,436,077 A 3/1984 Smith
4,552,365 A 11/1985 Smith
4,676,219 A 6/1987 Miller
4,949,494 A 8/1990 Mims
5,474,482 A * 12/1995 Davidson ..... A63H 27/12 446/41
5,692,489 A 12/1997 Swanson et al.
6,083,076 A * 7/2000 Saint-Victor ..... A63H 1/24 446/256
6,135,606 A * 10/2000 Fernandez ..... A23G 3/563 362/253
6,537,126 B2 * 3/2003 Wagner ..... A63H 33/00 446/236
6,802,755 B2 * 10/2004 Walker ..... A63H 33/26 446/175
7,074,106 B1 * 7/2006 Deutsch ..... A01K 15/025 446/175
7,361,074 B1 * 4/2008 Periman ..... A63H 37/00 362/199
7,771,247 B2 * 8/2010 Kessler ..... A63H 1/24 446/236
8,482,714 B1 * 7/2013 Seder ..... G09F 19/12 40/442

(Continued)

*Primary Examiner* — Alexander R Niconovich
(74) *Attorney, Agent, or Firm* — POLSINELLI PC

(57) ABSTRACT

Provided herein are devices for propelling string through the air. The device includes two wheels, a motor, a head, a handle, a detachable cover, and at least one UV light source. At least one of the two wheels can be operable to be driven by the motor. The two wheels can be rotatably mounted to the head and form a gap operable to receive a portion of the looped string. The wheels then propel the string from the device.

17 Claims, 24 Drawing Sheets

(56) References Cited

U.S. PATENT DOCUMENTS

| | | | | |
|---|---|---|---|---|
| 9,022,012 | B2 | 5/2015 | Loetz et al. | |
| 10,850,207 | B2 | 12/2020 | Tilley | |
| 11,674,774 | B2 * | 6/2023 | Fazio | F41B 4/00 124/78 |
| 11,879,703 | B2 * | 1/2024 | Fazio | F41B 4/00 |
| 11,918,927 | B1 * | 3/2024 | Fazio | A63H 29/24 |
| 12,025,399 | B2 * | 7/2024 | Fazio | F41B 4/00 |
| 12,097,447 | B2 * | 9/2024 | Kelly | A63H 33/22 |
| 2014/0295728 | A1 * | 10/2014 | Cayton | F21V 3/026 446/220 |
| 2015/0079868 | A1 | 3/2015 | Stites | |
| 2016/0074759 | A1 * | 3/2016 | Kelly | A63H 1/24 446/242 |
| 2019/0298010 | A1 | 10/2019 | Hacsi | |

* cited by examiner

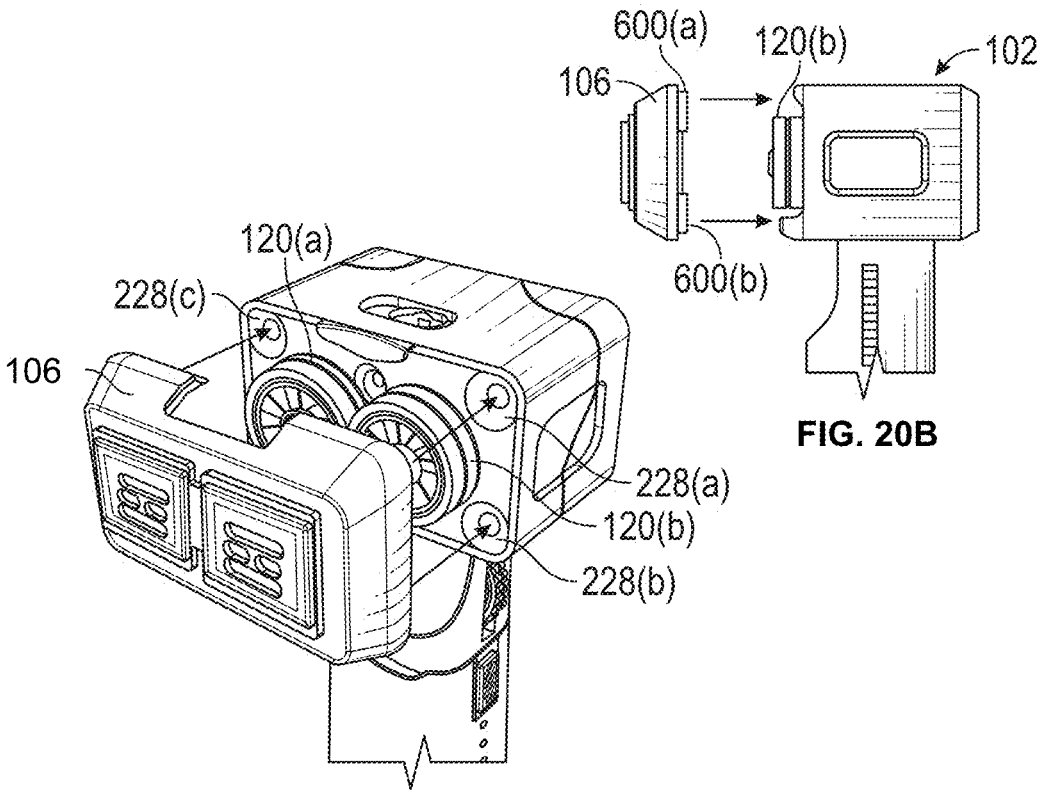
FIG. 20B
FIG. 20A
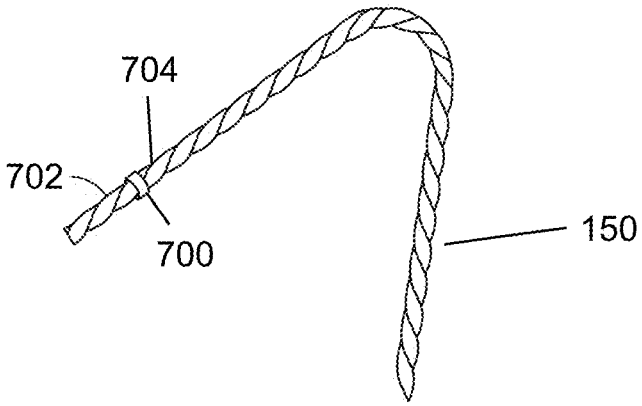
FIG. 21

DEVICES AND KITS FOR PROPELLING STRING AND METHODS OF USE THEREOF

CLAIM OF PRIORITY

This application is a continuation application of U.S. application Ser. No. 18/442,179, filed on Feb. 15, 2024, which claims priority under 35 USC § 119 (e) to U.S. Patent Application Ser. No. 63/597,947, filed on Nov. 10, 2023, the entire contents of each are hereby incorporated by reference.

FIELD OF DISCLOSURE

The present disclosure relates to a device for propelling string through the air. The device includes two driven wheels, a motor, a handle, a string, and a housing. The two driven wheels can be driven in opposite directions, thereby propelling a string through the air.

BACKGROUND

String propelling devices are hit toys for children as well as adults. However, many commercial string propelling devices have various drawbacks. Commercial string propelling devices have constant overheating issues, are not operable to be used in the dark, become easily tangled resulting in frustration of users, and have strings that are overly noisy or unstable.

Therefore, there is a need for a string propelling device that overcomes the drawbacks of current market string propelling devices.

SUMMARY

Provided herein is a device for propelling a looped string through air. The device can include a handle, a head attached to a proximal end of the handle, at least one motor housed within the head, two driven wheels operable to be driven by the at least one motor, a detachable cover operable to cover at least a portion of the two driven wheels, and at least one UV light source. The two driven wheels can be rotatably mounted to the head. In an aspect, the two driven wheels can include a gap operable to receive a portion of the looped string. In an aspect, the at least one UV light source is operable to provide UV light at a wavelength of about 315 nm to about 380 nm. In an aspect, the at least one UV light source comprises a first UV light source and a second UV light source, the first UV light source being located on an exterior surface of the head and the second UV light source located on the head within the detachable cover. In another aspect, the second UV light source is configured to provide UV light to a portion of the looped string inside of the detachable cover and the first UV light source is configured to provide UV light to a portion of the looped string outside of the detachable cover. In an aspect, the device further includes a light button having four modes, the four modes comprising an off mode, a first UV light source on mode, a second UV light source on mode, and a first UV light source and second UV light source on mode. In an aspect, the detachable cover has a plurality of vents.

In various aspects, the two driven wheels each have a plurality of fan blades extending radially from a cap towards a circumference of each wheel, the plurality of fan blades operable to draw air into the detachable cover through the plurality of vents thereby cooling the device. In an aspect, the head includes an upper U-shaped projection, a lower U-shaped projection, and one or more head attachment mechanisms operable to couple to one or more detachable cover attachment mechanisms. In an aspect, the upper U-shaped projection and the lower U-shaped projection are operable to align with the gap between the two driven wheels and receive the looped string. In an aspect, the one or more head attachment mechanisms comprise one or more magnets and the one or more detachable cover attachment mechanisms comprise one or more magnets. In another aspect, the device includes a light filter operable to narrow a bandwidth of the at least one UV light source. In an aspect, the detachable cover comprises a translucent material. In another aspect, the detachable cover comprises a UV reactive material, the UV reactive material operable to illuminate when provided light by the at least one UV light source. In an aspect, the at least one UV light source emits light that is invisible to a human eye.

In an aspect, the device further includes a rechargeable battery housed within the handle or the head, the rechargeable battery electrically coupled to the at least one motor and operable to provide power to the at least one motor and a charging port operable to electrically connect to a power source, the charging port located on an exterior surface of the head or the handle. In another aspect, the head further comprises a plurality of vents on a side opposite the detachable cover. In an aspect, the device further includes one or more heat sinks coupled to the at least one UV light source and/or the at least one motor.

Further provided herein is a device for propelling a looped string through air. The device can include a handle, a head attached to a proximal end of the handle, at least one motor housed within the head, two driven wheels operable to be driven by the at least one motor, a detachable cover operable to cover at least a portion of the two driven wheels, and at least one UV light source. The head can include an upper U-shaped projection, a lower U-shaped projection, and one or more head attachment mechanisms. The device can further include a rechargeable battery in electric communication with the at least one motor. Each of the two driven wheels can be rotatably mounted to the head. In an aspect, each of the two driven wheels include a plurality of fan blades extending radially from a cap toward a circumference of each of the two driven wheels. The two driven wheels define a gap operable to receive the looped string. In an aspect, the detachable cover includes a translucent material comprising a UV reactive material, one or more detachable cover attachment mechanisms operable to couple to the one or more head attachment mechanisms, and a plurality of vents operable to allow air to enter into the detachable cover. In an aspect, the device includes a first UV light operable to provide UV light at a wavelength of about 315 nm to about 390 nm, the first UV light located on the head within the detachable cover. In an aspect, the device includes a second UV light operable to provide UV light at a wavelength of about 315 nm to about 390 nm, the second UV light located on an exterior surface of the head.

Further provided herein is a looped string. The looped string can include a first string having a first end and a second end and a second string having a first end and a second end. In an aspect, the first end of the first string is permanently coupled to the first end of the second string. In another aspect, the second end of the first string is permanently coupled to the second end of the second string. In an aspect, the first string and the second string comprise a polyester material and a cotton material. In another aspect, the polyester materials of the first string and the second string are heated at the first ends and the second ends thereby permanently coupling the first ends and the second ends at a connection point. In another aspect, the first string comprises a first fluorescent dye and the second string comprises a second fluorescent dye. In another aspect, the looped string further includes one or more additional strings coupled to the first string and/or the second string to form the looped string. In another aspect, the looped string further includes the first fluorescent dye and the second fluorescent dye illuminate in different colors when provided an excitation light. In an aspect, the connection point has substantially the same diameter as the looped string.

Other aspects and iterations of the invention are described more thoroughly below.

BRIEF DESCRIPTION OF FIGURES

The description will be more fully understood with reference to the following figures and graphs, which are presented as various embodiments of the disclosure and should not be construed as a complete recitation of the scope of the disclosure. It is noted that, for purposes of illustrative clarity, certain elements in various drawings may not be drawn to scale. Understanding that these drawings depict only exemplary embodiments of the disclosure and are not therefore to be considered limiting of its scope, the principles herein are described and explained with additional specificity and detail through the use of the accompanying drawings in which:

FIG. 20A is a view of a detachable cover being coupled to a device for propelling string in one example.

FIG. 20B is a view of a detachable cover being coupled to a device for propelling string in one example.

FIG. 21 is a view of a string with a connection point in one example.

Reference characters indicate corresponding elements among the views of the drawings. The headings used in the figures do not limit the scope of the claims.

DETAILED DESCRIPTION

Figure 1:
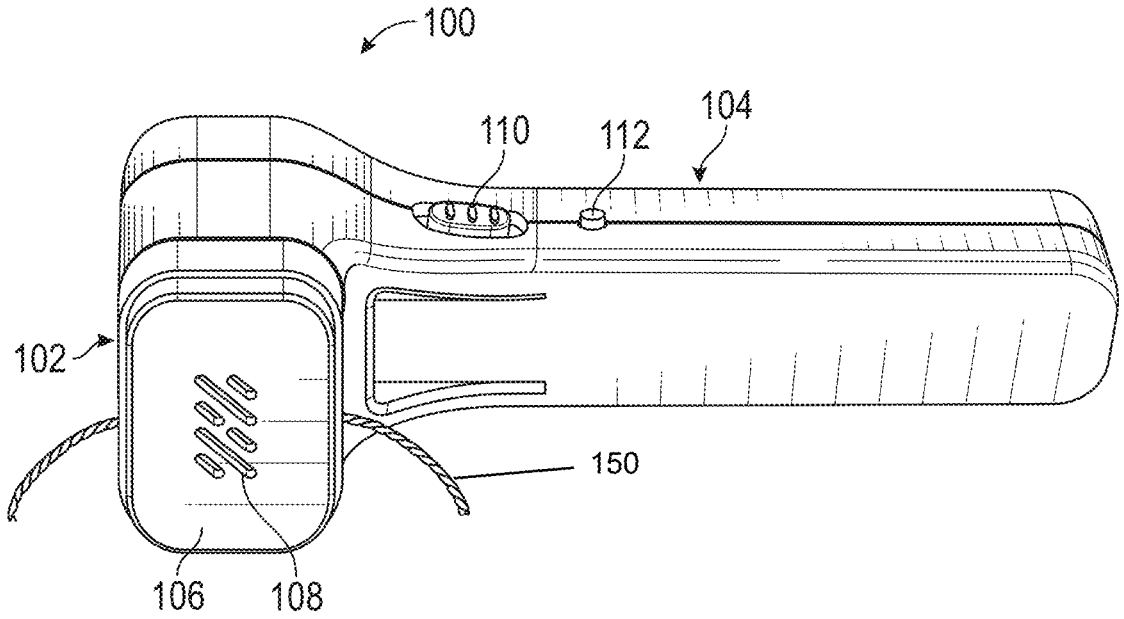
FIG. 1 is an isometric front view of a device for propelling string in one example.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Thus, the following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be references to the same embodiment or any embodiment; and such references mean at least one of the embodiments.

Reference to "one embodiment", "an embodiment", or "an aspect" means that a particular feature, structure, or characteristic described in connection with the embodiment is included in at least one embodiment of the disclosure. The appearances of the phrase "in one embodiment" or "in one aspect" in various places in the specification are not necessarily all referring to the same embodiment, nor are separate or alternative embodiments mutually exclusive of other embodiments. Moreover, various features are described which may be exhibited by some embodiments and not by others.

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms are provided. A recital of one or more synonyms does not exclude the use of other synonyms. The use of examples anywhere in this specification including examples of any terms discussed herein is illustrative only and is not intended to further limit the scope and meaning of the disclosure or of any example term. Likewise, the disclosure is not limited to various embodiments given in this specification.

As used herein, "about" refers to numeric values, including whole numbers, fractions, percentages, etc., whether or not explicitly indicated. The term "about" generally refers to a range of numerical values, for instance, ±0.5-1%, ±1-5% or ±5-10% of the recited value, that one would consider equivalent to the recited value, for example, having the same function or result.

The term "substantially" is defined to be essentially conforming to the particular dimension, shape or other word that substantially modifies, such that the component need not be exact.

The terms "comprising," "including" and "having" are used interchangeably in this disclosure. The terms "comprising," "including" and "having" mean to include, but not necessarily be limited to the things so described.

The term "coupled" as used herein is defined as connected, whether directly or indirectly through intervening components, and is not necessarily limited to physical connections. The connection can be such that the objects are permanently connected or releasably connected.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

Provided herein is a device for propelling a string through the air. The device can include a handle, a head attached to a proximal end of the handle, at least one motor housed within the head, two driven wheels operable to be driven by the at least one motor and rotatably mounted to the head, a detachable cover operable to cover at least a portion of the two driven wheels, a looped string operable to be inserted in a gap between the two driven wheels, and at least one UV light source.

Many string propelling devices (e.g., string shooters) known in the art have drawbacks. For example, many string propelling devices are not operable to be used in the dark, easily tangle the string due to inadequate loading configurations, overheat easily, and make undesired noise when in operation. The string propelling device provided herein solves these problems. The string propelling devices utilizes UV reactive strings operable to illuminate (e.g., glow in the dark) allowing the string propelling device to be used at any time of the day. The string propelling device provides easy assembly and avoids tangling due to a novel string loading mechanism. The string propelling device provides dual functionality for driven wheels that are operable to both propel the string and cool the device. Further, the string propelling device utilizes seamless string connection points using novel string loop manufacturing methods, thereby preventing undesired noise in operation and tangling.

Figure 4:
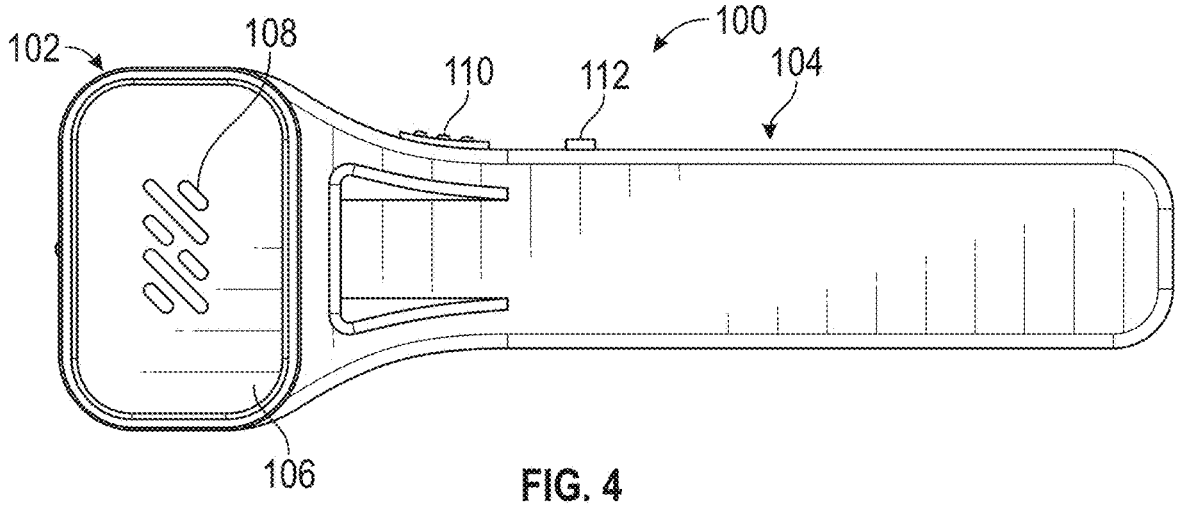
FIG. 4 is a front view of a device for propelling string in one example.
Figure 5:
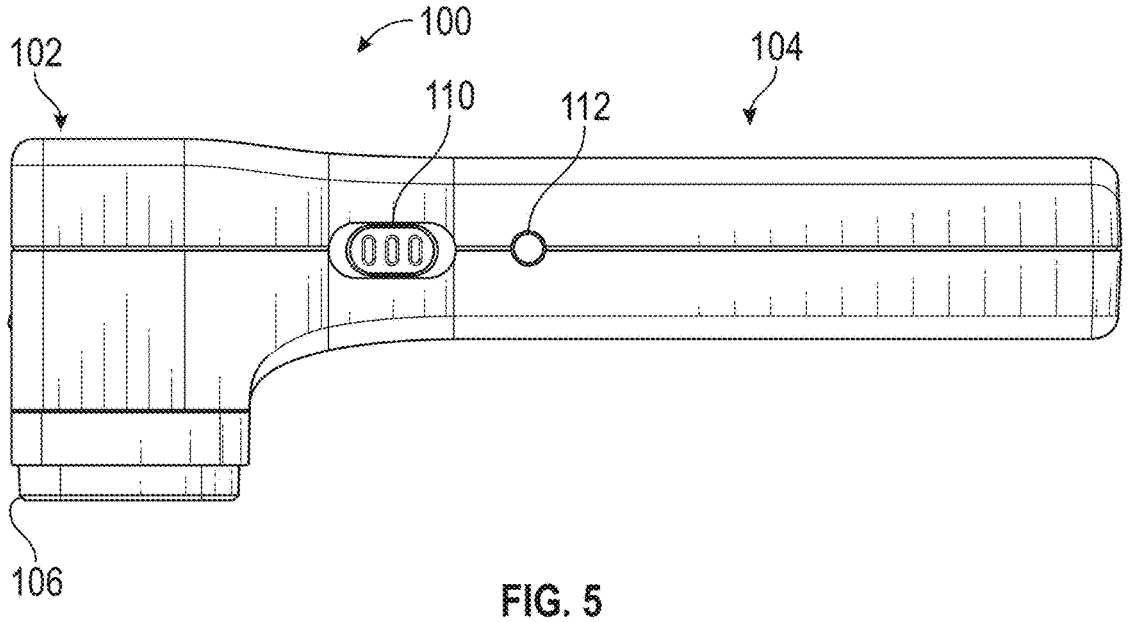
FIG. 5 is a side view of a device for propelling string in one example.

As illustrated in FIGS. 1, 4, and 5, the device 100 can include a handle 104 and a head 102. A string 150 can be attached to the head 102 and propelled by the device 100, as described further herein. The string 150 can be a looped string (e.g., a sting with no ends). The head 102 can be attached to a proximal end of the handle 104. In some examples, the handle 104 and the head 102 can be manufactured as a single piece. In another example, the head 102 can be configured to be coupled to the handle 104 using screws, snap fit connects, permanent welds, or other attachment means known in the art. In some examples, the head 102 and the handle 104 can comprise two components, a first portion 308 and a second portion 306, as illustrated, for example, in FIG. 16. The first portion 308 can include a portion of the head 102 and a portion of the handle 104 and the second portion 306 can include a portion of the head 102 and a portion of the handle 104. The two portions 306, 308 can be coupled and uncoupled from each other. Uncoupling the first portion 308 and the second portion 306 can allow access to the internal components of the device 100. In some aspects, the first portion 308 and the second portion 306 can be permanently coupled. In other examples, the first portion 308 and the second portion 306 can be removably coupled using attachment mechanisms such as screws and screw holes, snap-fit connections, magnets, latches, or other connection mechanisms operable to connect the first portion 308 and the second portion 306.

The head 102 can include a detachable cover 106. The detachable cover 106 can have one or more front vents 108. The one or more front vents 108 can allow air to enter into the device 100. Air can be drawn into the device 100 through the one or more front vents 108 by two driven wheels, as described further herein. The device 100 can further include a power switch 110. The power switch 110 can be in electrical communication with at least one motor. The at least one motor can be operable to drive (e.g., rotate) the two driven wheels. The power switch 110 can have an on position and an off position. The on position of the power switch 110 turns the at least one motor on, while the off position of the power switch 110 turns the at least one motor off. The handle 104 can further include a button 112. The button 112 can be operable to turn on and off one or more UV light sources, as described further herein.

Figure 2:
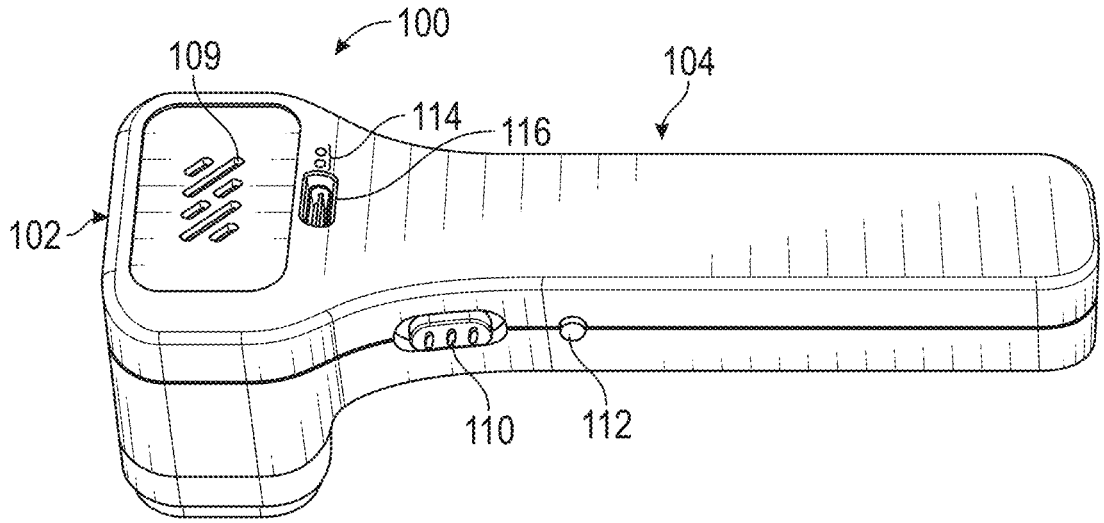
FIG. 2 is an isometric rear view of a device for propelling string in one example.

As illustrated in FIG. 2, the head 102 can include one or more rear vents 109 (e.g., on an opposing side of the head from the detachable cover 106). The one or more rear vents 109 are operable to allow air to exit the device 100. The head 102 can further include a charging port 116 and one or more indicator lights 114. The charging port 116 can be in electrical communication with one or more rechargeable batteries. The one or more rechargeable batteries can be housed within the head 102 or the handle 104. The one or more rechargeable batteries can be operable to power the at least one motor and the one or more UV light sources. The charging port 116 can be a USB-A charging port, a USB-B charging port, a USB-C charging port, or any other type of charging port. The charging port 116 can be operable to receive a charging cord connected to a power source, thereby charging the one or more batteries in the device 100. The one or more indicator lights 114 can include a first indicator light and a second indicator light. In some examples, the first indicator light and the second indicator light can be different colors or the same color. In some examples, the first indicator light can change colors depending on a status of the device 100. For example, the first indicator light can be green when the device 100 is on and charged. The first indicator light can be off when the device 100 is off. The first indicator light can be red when the device 100 has low battery. The second indicator light can be on when the charging port 116 is connected to a power source, thereby indicating the device 100 is charging. The second indicator light can be off when the device is not connected to a power source.

In other examples, the battery or batteries can be single-use batteries. The device 100 can include a battery port where a user can insert one or more single-use batteries to power the device 100.

Figure 3:
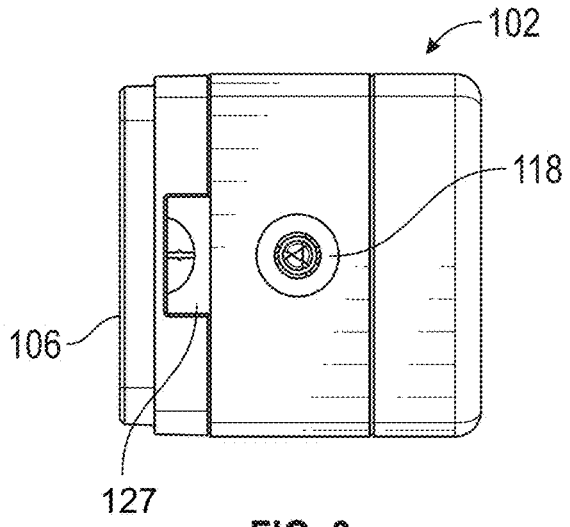
FIG. 3 is a top view of a device for propelling string in one example.

As illustrated in FIG. 3, the head 102 can include a first UV light source 118 on an upper surface (e.g., the surface on the opposite side of the handle 104). The first UV light source 118 is operable to emit a first UV light. In some examples, the first UV light can have a wavelength of about 315 nm to about 330 nm, about 330 nm to about 345 nm, about 345 nm to about 360 nm, about 360 nm to about 375 nm, about 375 nm to about 390 nm, or about 390 nm to about 400 nm. The first UV light source 118 can be operable to provide excitation light to string 150. The string 150 can be reactive to UV light creating a glowing effect, as described further herein. In some examples, the first UV light source 118 can further include a UV filter operable to maximize the emission of 365 nm UV light while blocking any visible light from being emitted by the first UV light source 118. The UV light filter can narrow the bandwidth of the first UV light source 118. In some examples, the first UV light source 118 can be replaced with another type of light source (e.g., visible light, near infrared light, etc.) In other examples, one or more additional light sources (e.g., visible light source, near infrared light source, UV light source) can be located on the upper surface of the head 102 along with the first UV source 118. In some examples, the first UV light source 118 and/or one or more additional light sources can be located on any surface of the head 102. In some examples, the first UV light source 118 and/or one or more additional light sources are located on the head 102 such that the first UV light source 118 and the one or more additional light sources are operable to emit light towards the string 150.

In at least one example, the head 102 can have an upper projection operable to fit with the detachable cover 106 and form a gap such that the string 150 fits within the gap. As illustrated in FIG. 3, the head 102 can have an upper U-shaped projection 127. The upper U-shaped projection 127 can be located on the same side of the head 102 as the detachable cover 106. The upper U-shaped projection 127 can be operable to hold the string 150 in place. The upper U-shaped projection 127 and the detachable cover 106 can be configured to fit together such that the string 150 fits within a gap produced by the edges of the upper U-shaped projection 127 and the detachable cover 106. In this manner, the string 150 can be held in a position such that tangling of the string 150 is prevented.

In at least one example, the head can have a lower projection operable to fit with the detachable cover 106 and form a gap such that the string fits within the gap. Similar to the upper projection, the lower projection can be a lower U-shaped projection 126, as illustrated, for example in FIG. 6. The lower U-shaped projection 126 can be located on the same side of the head 102 as the detachable cover 106. The lower U-shaped projection 126 can be operable to hold the string 150 in place. The lower U-shaped projection 126 and the detachable cover 106 can be configured to fit together such that the string 150 fits within a gap produced by the edges of the lower U-shaped projection 126 and the detachable cover 106. In this manner, the string 150 can be held in a position such that tangling of the string 150 is prevented.

Figure 6:
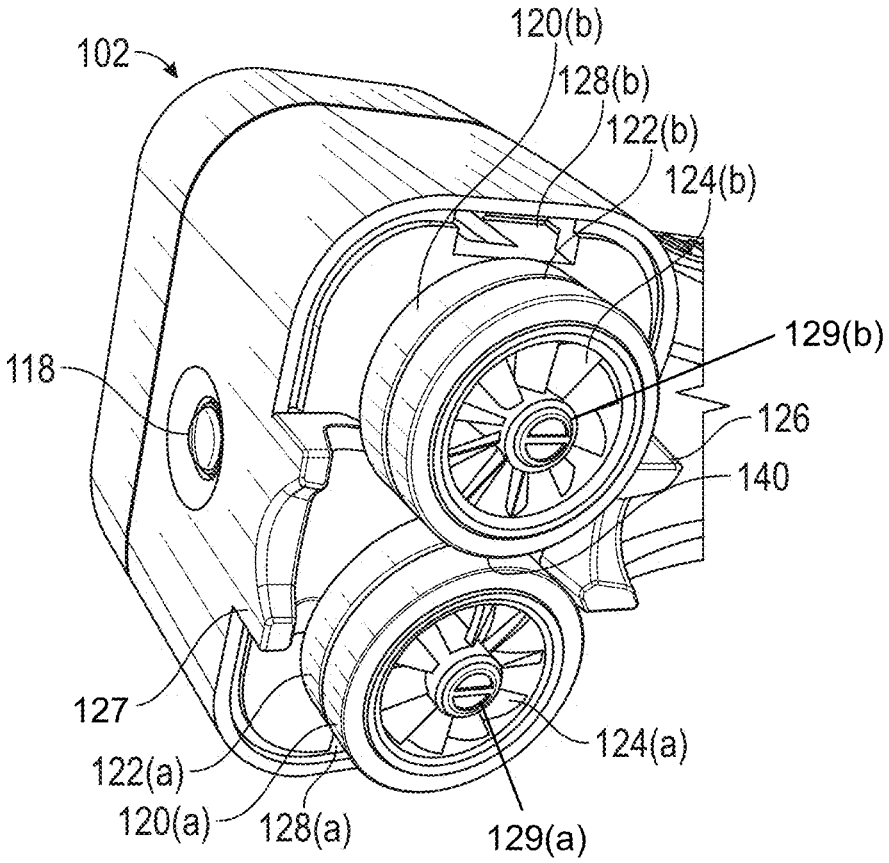
FIG. 6 is a front view of a device for propelling string without a detachable cover in one example.
Figure 7:
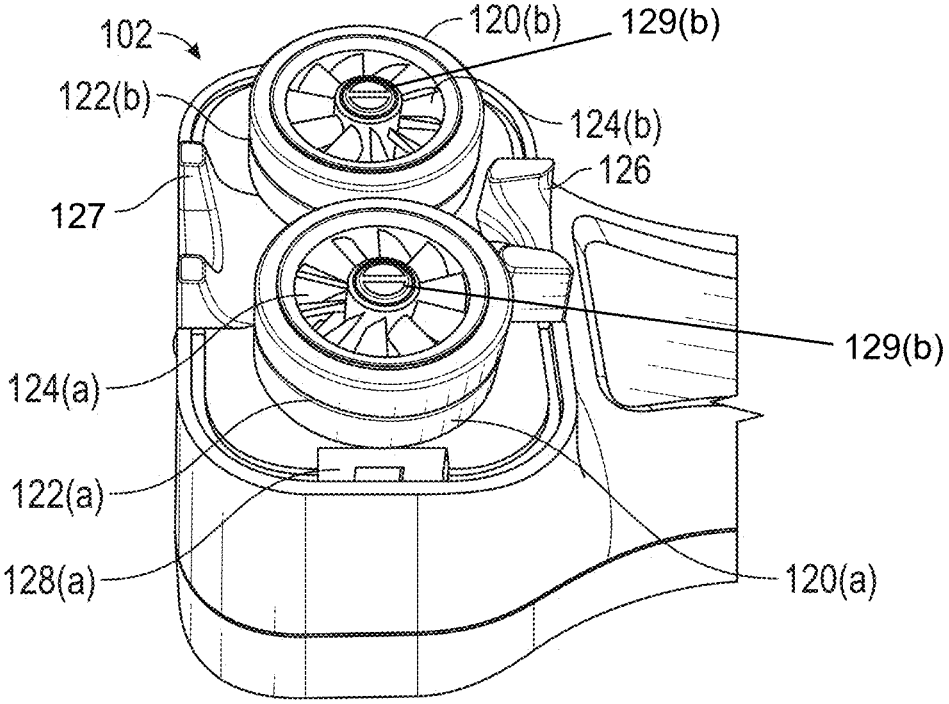
FIG. 7 is a front view of a device for propelling string without a detachable cover in one example.

As illustrated in FIGS. 6-7, the device 100 can include two wheels, a first wheel 120(*a*) and a second wheel 120(*b*). In some examples, the first wheel 120(*a*) and the second wheel 120(*b*) can both be driven wheels. The first wheel 120(*a*) and the second wheel 120(*b*) can each be coupled to a motor spindle which is connected to at least one motor. In some examples, the first wheel 120(*a*) can have a cap 129(*a*) and the second wheel 120(*b*) can have a cap 129(*b*). In some examples, the caps 129(*a*), 129(*b*) can be operable to couple to the corresponding motor spindles. The caps 129(*a*), 129(*b*) can create a friction fit with the corresponding motor spindles to couple the first wheel 120(*a*) and the second wheel 120(*b*) to the motor spindles. In some examples, the caps 129(*a*), 129(*b*) can have threads that screw to corresponding threads on the corresponding motor spindles. The caps 129(*a*), 129(*b*) can have a set depth such that the first wheel 120(*a*) and the second wheel 120(*b*) are aligned (e.g., the distal most portion of the first wheel 120(*a*) and the second wheel 120(*b*) are at the same distance from the head 102). In some examples, the first wheel 120(*a*) and the second wheel 120(*b*) can have a separate motor (e.g., a first motor and a second motor). The at least one motor can be coupled to a battery housed within the interior of the handle 104 and/or the head 102. The first wheel 120(*a*) and second wheel 120(*b*) can have a gap 140 between them operable to receive the string 150. The first wheel 120(*a*) can have a groove 122(*a*) and the second wheel 120(*b*) can have a groove 122(*b*) along an exterior circumference of the first wheel 120(*a*) and the second wheel 120(*b*), respectively. The grooves 122(*a*), 122(*b*) can be operable to hold the string 150 in a set location along the first wheel 120(*a*) and the second wheel 120(*b*), thereby preventing tangling of the string. The grooves 122(*a*), 122(*b*) can ensure that the string remains a set distance from the head 102.

The first wheel 120(*a*) and the second wheel 120(*b*) can be driven by the at least one motor at a rotation rate sufficient to propel the string 150 in the air. In some examples, the first wheel 120(*a*) and the second wheel 120(*b*) can be driven by the at least one motor operating at a rotation rate of at least about 40,000 revolutions per minute (rpm). In some examples, the at least one motor can operate at about 40,000 rpm to about 45,000 rpm, about 45,000 rpm to about 50,000 rpm, about 50,000 rpm to about 55,000 rpm, about 55,000 rpm to about 60,000 rpm, or more. The string 150 can be propelled at a speed of about 20 miles per hour (mph) to about 25 mph, about 25 mph to about 30 mph, about 30 mph to about 35 mph, about 35 mph to about 40 mph, or more.

The at least one motor can have a power cut off switch. For example, the at least one motor can be in communication with a controller operable to control the operation of the at least one motor. In some examples, it can be desirable to control the operation of the at least one motor automatically (e.g., without a user input). For example, if the string 150 becomes tangled between the first wheel 120(*a*) and the second wheel 120(*b*), the tangle can provide a strain, excessive force, and/or excessive load on the at least one motor, thereby causing damage to the at least one motor. For example, when excessive force, strain, and/or load is placed on the at least one motor, the at least one motor can burnout and/or produce excessive heat causing a safety issue. The at least one motor can have at least one sensor, for example, a stress sensor, a current sensor, or other sensors operable to determine the load, stress, and/or strain on the motor. If the load, stress, or strain on the at least one motor exceeds a threshold, the controller is operable to automatically shut off the at least one motor, thereby preventing damage to the at least one motor. The threshold can be a threshold based on a percentage of the at least one motor's normal operating load, stress, and/or strain. For example, the threshold can be at about 110% to about 120%, about 120% to about 130%, about 130% to about 140%, about 140% to about 150%, or more of the at least one motors normal operating load, stress, and/or strain. Further, the power shut off can prevent damage to a tangled string by preventing the at least one motor from continuing to propel the tangled string. The tangled string can be removed and untangled or replaced with a new string and operation of the device 100 can return to a normal operating mode (e.g., functions as described herein).

In at least one example, the power cut off switch can be in communication with a controller and at least one current sensor. The threshold can be determined by a measurement of the current (e.g., electrical current) powering the at least one motor. In some examples, the current is measured in amperes. The threshold for automatically activating the power cut off switch, and thereby turning off the at least one motor, can be determined by the type of motor or motors used and a chosen maximum current for the at least one motor. In some examples, the threshold is the measurement of current that prevents damage to the at least one motor.

The first wheel 120(*a*) can have a plurality of interior fan blades 124(*a*) and the second wheel 120(*b*) can have a plurality of interior fan blades 124(*b*). The plurality of interior fan blades 124(*a*), 124(*b*) can extend radially from the caps 129(*a*), 129(*b*) towards the circumference of the first wheel 120(*a*) and the second wheel 120(*b*), respectively. The interior fan blades 124(*a*), 124(*b*) are operable to pull air into the device 100 through the one or more front vents 108 of the detachable cover 106. Behind the first wheel 120(*a*) and the second wheel 120(*b*) can be one or more air inlets. The air inlets can allow the air pulled into the device 100 by the interior fan blades 124(*a*), 124(*b*) to enter the interior of the device 100. As cool air from outside the device 100 is pulled into the device 100, the cool air can be passed around the battery, the at least one motor, and other interior components within the device 100. The cool air can cool the internal components of the device 100 and then flow out the one or more rear vents 109 of the device. In this manner, the internal components of the device 100 can be cooled thereby regulating the temperature within the device 100, maintaining consistent performance, and reducing the risk of overheating. In some examples, heat sinks can be located proximal the at least one motor and battery and the air can flow through the heat sinks taking the heat away from the at least one motor and battery and expelling the heat out the one or more rear vents 109. The interior fan blades 124(*a*), 124(*b*) can have a blade pitch of about 10 degrees to about 20 degrees, about 10 degrees to about 11 degrees, about 11 degrees to about 12 degrees, about 12 degrees to about 13 degrees, about 13 degrees to about 14 degrees, about 14 degrees to about 15 degrees, about 15 degrees to about 16 degrees, about 16 degrees to about 17 degrees, about 17 degrees to about 18 degrees, about 18 degrees to about 19 degrees, about 19 degrees to about 20 degrees, or more. The interior fan blades 124(*a*), 124(*b*) can be symmetrically spaced or asymmetrically spaced. The first wheel 120(*a*) and the second wheel 120(*b*) can have about 3, 4, 5, 6, 7, 8, 9, 10, 11, 12, 13, 14, 15, or more interior fan blades.

The head 102 can further include one or more attachment mechanisms operable to removably couple to one or more attachment mechanisms of the detachable cover 106. For example, the one or more attachment mechanisms on the head 102 can include a first snap-fit port 128(*a*) and a second snap-fit port 128(*b*) corresponding to a first snap-fit projection and a second snap-fit projection on the detachable cover 106. In other examples, other attachment mechanisms such as magnets, latches, Velcro, other snap fit arrangements, rotatable mating mechanisms, clips, and other mating/attachment mechanisms operable to attach the detachable cover 106 to the head 102 can be used.

The device 100 can include a lower U-shaped projection 126. The lower U-shaped projection 126 can be located on the same side of the head 102 as the detachable cover 106. The lower U-shaped projection 126 and the upper U-shaped projection 127 can be aligned with the gap 140 between the two wheels 120(*a*), 120(*b*). When the detachable cover 106 is coupled to the head 102 and the string 150 is inserted between the gap 140 and within the openings defined by the upper U-shaped projection 127 and the detachable cover 106 and the lower U-shaped projection 126 and the detachable cover 106, the string 150 can be contained in a propulsion line defined by the gap 140, the gap formed by the upper U-shaped projection 127 and detachable cover 106, and the gap formed by the lower U-shaped projection 126 and the detachable cover 106. In this manner, some longitudinal motion of the string 150 (e.g., towards either side of the head 102) is allowed while also preventing tangling of the string 150. In some examples, the upper U-shaped projection 127 and the lower U-shaped projection 126 can be other shapes. For example, the upper U-shaped projection 127 and the lower U-shaped projection 126 can be circular projections or square projections with an opening or other shapes operable to contain the string 150 such that the string does not become tangled when propelled by the first wheel 120(*a*) and the second wheel 120(*b*).

Figure 28:
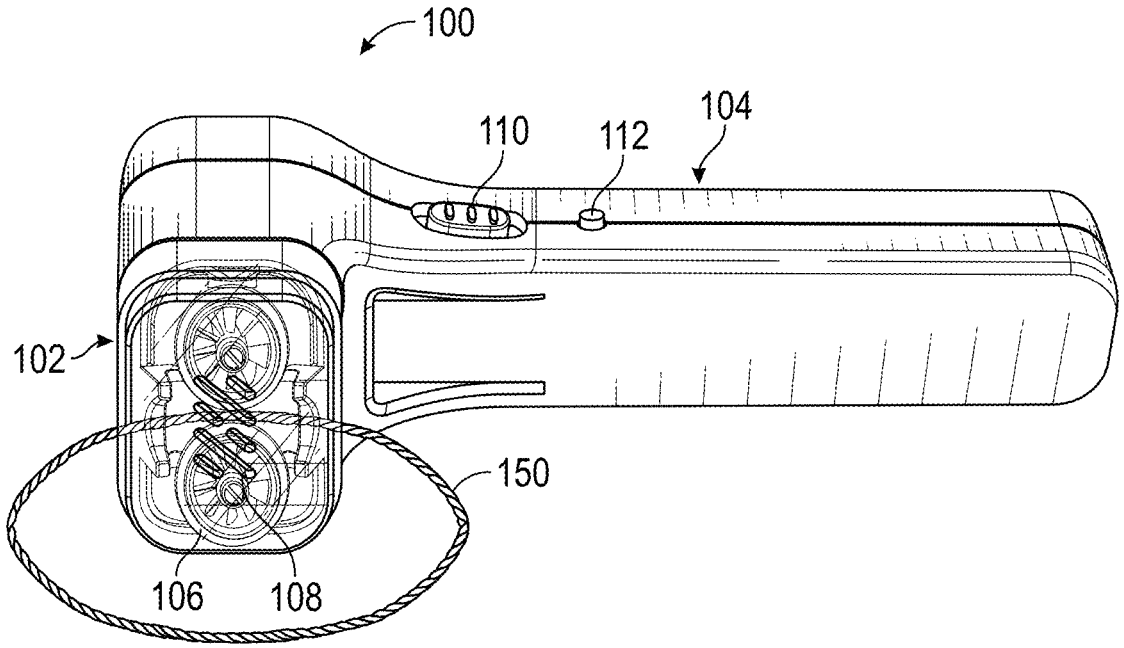
FIG. 28 is an isometric front view of the device.

FIGS. 8-14 illustrate the device 100 in another example. The device 100 can include a head 102 and a handle 104. The device 100 can include a detachable cover 106. The detachable cover 106 can include a first vent 208(*a*) and a second vent 208(*b*). The first vent 208(*a*) and the second vent 208(*b*) can each include one or more vent holes. The first vent 208(*a*) can correspond to the first wheel 120(*a*) and the second vent 208(*b*) can correspond to the second wheel 120(*b*). In some examples, the detachable cover 106 can be made of a transparent or translucent material (for example as shown in FIG. 28). In some examples, the detachable cover 106 can include a transparent UV reactive material operable to glow. In some examples, the UV reactive material of the detachable cover 106 can be provided an excitation light from a second UV light source (e.g., internal UV light source) as described further herein.

In some examples, the detachable cover 106 can be made of UV reactive materials in a pattern. For example, different UV materials can be used to create patterns in the detachable cover. The detachable cover 106 can include fluorescent and/or phosphorescent materials. In some examples, the patterns can include various graphical designs, natural patterns, objects, and any other desired design. In some examples, the UV material or materials of the detachable cover can be provided excitation light from the second UV light source (e.g., internal UV light source) as described further herein.

Figure 8:
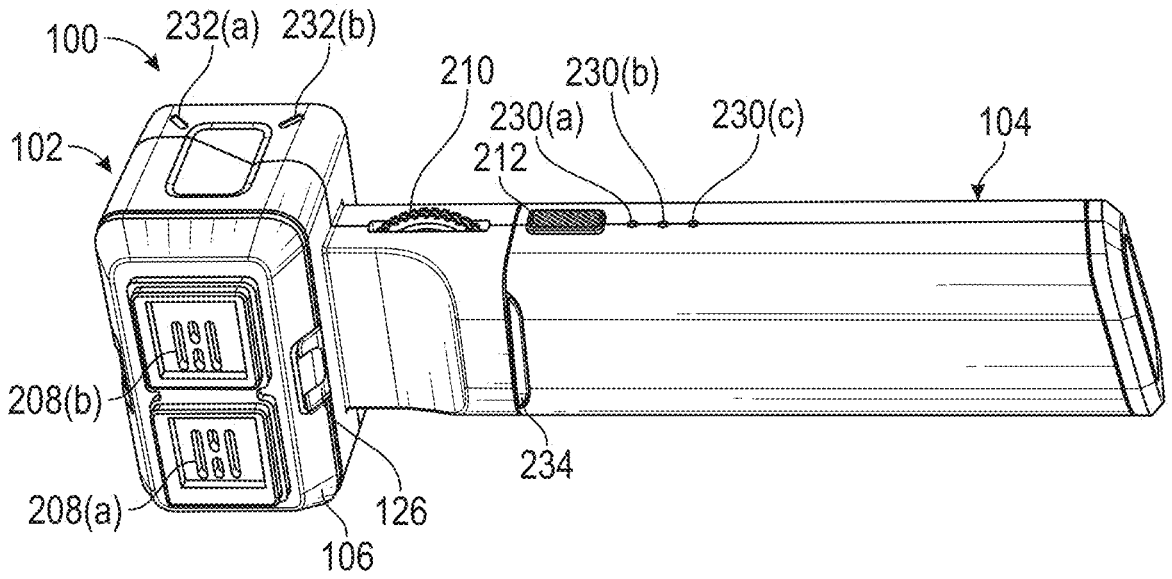
FIG. 8 is an isometric front view of a device for propelling string in one example.

As illustrated in FIG. 8, the device 100 can include a power wheel 210 on the handle 104. The power wheel 210 can be operable to actuate the at least one motor thereby driving (e.g., rotating) the first wheel 120(*a*) and the second wheel 120(*b*). The power wheel 210 can allow more detailed control of the speed of the first wheel 120(*a*) and the second wheel 120(*b*) than the power switch 110 described above. The power wheel 210 can be rotated by a user to control the rotation rate of the at least one motor. For example, rotating the power wheel 210 turns the at least one motor on and the further the power wheel 210 is rotated the more power is supplied to the at least one motor, thereby supplying a faster rotation rate to the motor spindles and the first wheel 120(*a*) and the second wheel 120(*b*).

The device 100 can further include a button 212. The button 212 can control the first UV light source 118 and a second UV light source 242, as illustrated, for example, in FIGS. 13-14. The button 212 can have one or more modes. In one example, the button 212 can have four modes. The button 212 can be cycled through the four modes by clicking on the button 212. For example, the button 212 can be clicked a first time to enter a first mode. In the first mode, the first UV light source 118 can be turned on (e.g., the first UV light source 118 begins emitting light). The button 212 can be clicked a second time to enter a second mode. In the second mode, the first UV light source 118 can be turned off and the second UV light source 242 is turned on. The button 212 can be clicked a third time to enter a third mode. In the third mode, the first UV light source 118 and the second UV light source 242 are both turned on. The button 212 can be clicked a fourth time to enter a fourth mode. In the fourth mode, both the first UV light source 118 and the second UV light source 242 are turned off. In other examples, other configurations and modes can be used. For example, the button 212 can have only an on mode for a first click and an off mode for a second click. In another example, it will be appreciated that the four modes can be cycled on different numbers of clicks.

Figure 9:
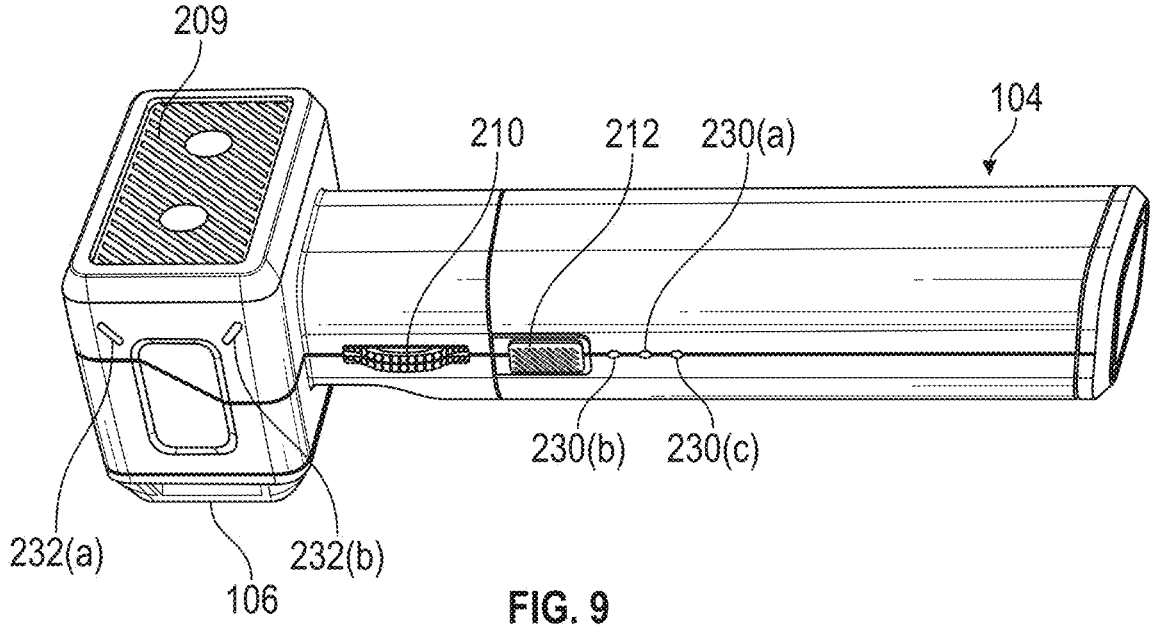
FIG. 9 is an isometric rear view of a device for propelling string in one example.

The device 100 can further include one or more indicator lights. As illustrated in FIGS. 8-9, the device 100 can include three indicator lights 230(*a*), 230(*b*), 230(*c*). The three indicator lights 230(*a*), 230(*b*), 230(*c*) can indicate a battery level of the device. For example, when all three indicator lights 230(*a*), 230(*b*), 230(*c*) are illuminated the device 100 has a full battery. When only two of the three indicator lights 230(*a*), 230(*b*), 230(*c*) are illuminated, the device 100 has a slightly diminished battery. When only one of the three indicator lights 230(*a*), 230(*b*), 230(*c*) is illuminated, the device 100 has a lower battery, indicating to a user that the device should be charged.

As illustrated in FIG. 8, the device 100 can further include an on/off indicator light 234. The on/off indicator light 234 can indicate to a user that the device 100 is on or off. When the on/off indicator light 234 is illuminated, the device 100 is on. When the on/off indicator light 234 is not illuminated, the device 100 is off. As described above, the device 100 can be turned on by actuating the power switch 110 or the power wheel 210.

Figure 10:
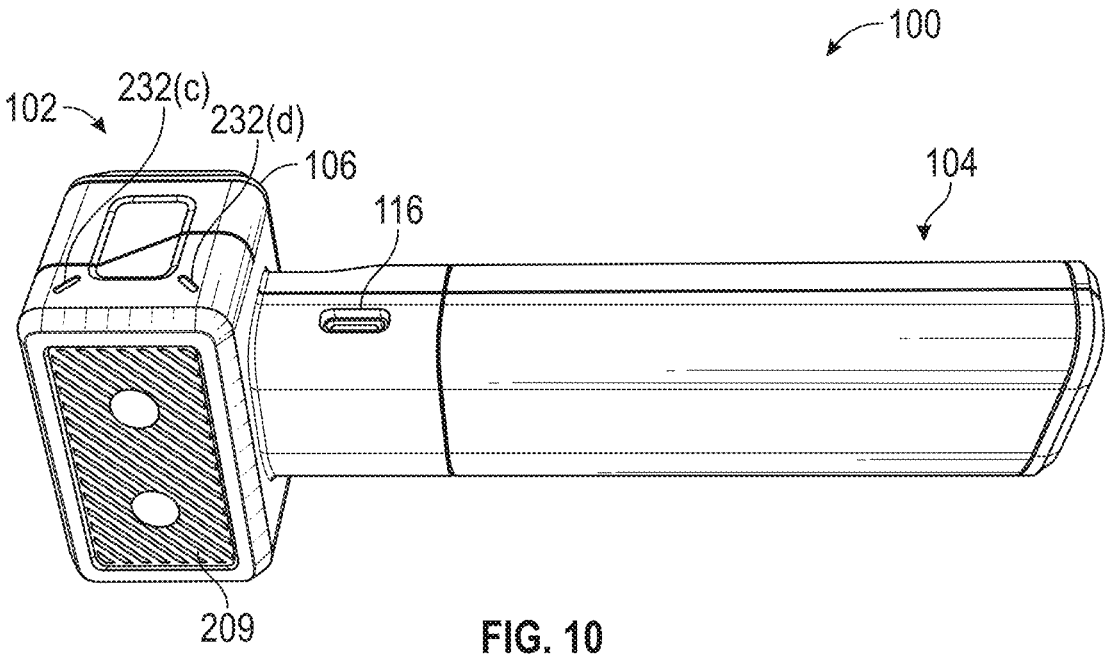
FIG. 10 is an isometric rear view of a device for propelling string in one example.

As illustrated in FIGS. 8 and 10, the device 100 can further include one or more accent lights. In an example, the device can include a first accent light 232(*a*) and a second accent light 232(*b*) located on the head 102, as illustrated in FIG. 8. The device 100 can further include a third accent light 232(*c*) and a fourth accent light 232(*d*) on an opposite side of the head 102 from the first accent light 232(*a*) and the second accent light 232(*b*), as illustrated in FIG. 10.

Figure 11:
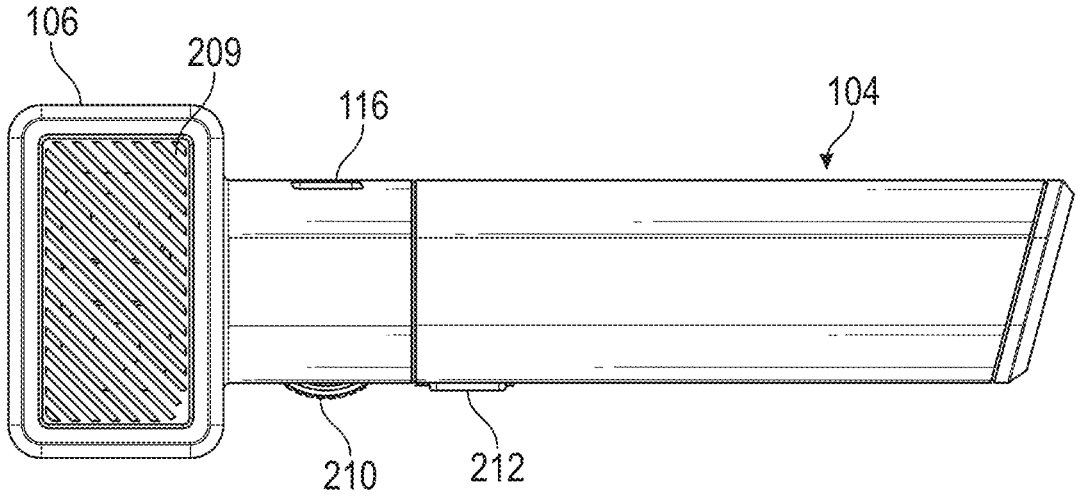
FIG. 11 is a rear view of a device for propelling string in one example.

As illustrated in FIGS. 9-11, the device 100 can have one or more rear vents 209 on a rear face of the device. In some examples, the one or more rear vents 209 can be a mesh configured to allow air to flow out of the device 100. In some examples, the one or more rear vents 209 can be part of a detachable back cover configured to connect to the head 102 on an opposite side from the detachable cover 106. The detachable back cover can allow access to the interior of the device. For example, the detachable back cover can be removably coupled to the head using magnets, snap-fit connections, latches, Velcro, or other attachment mechanisms operable to attach the detachable back cover to the head 102.

Figure 13:
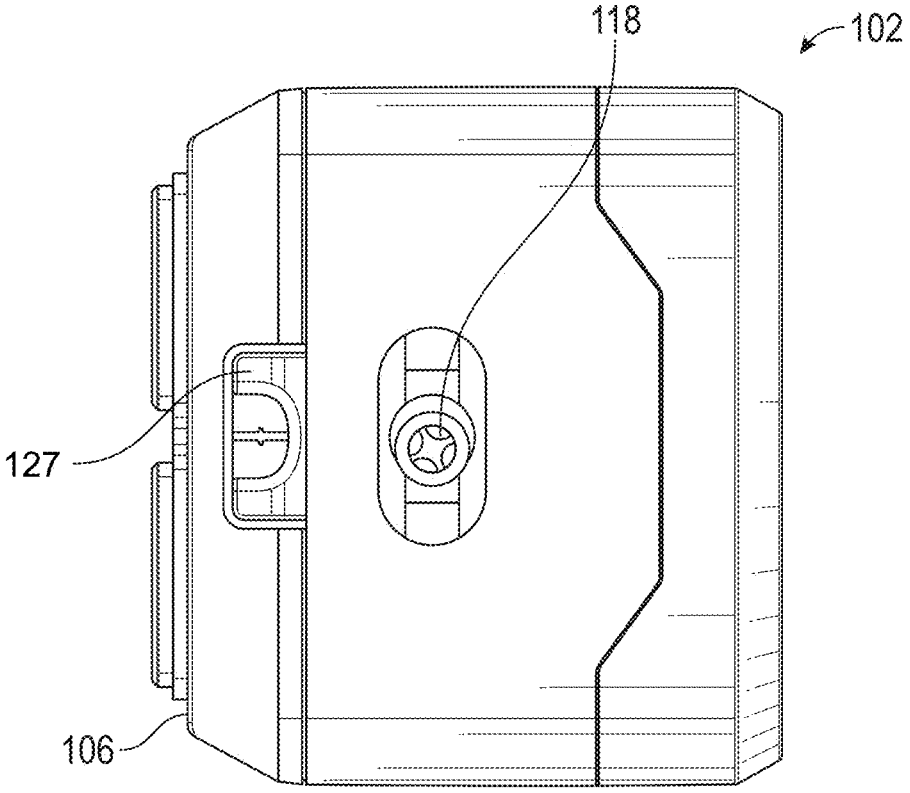
FIG. 13 is a top view of a device for propelling string in one example.
Figure 14:
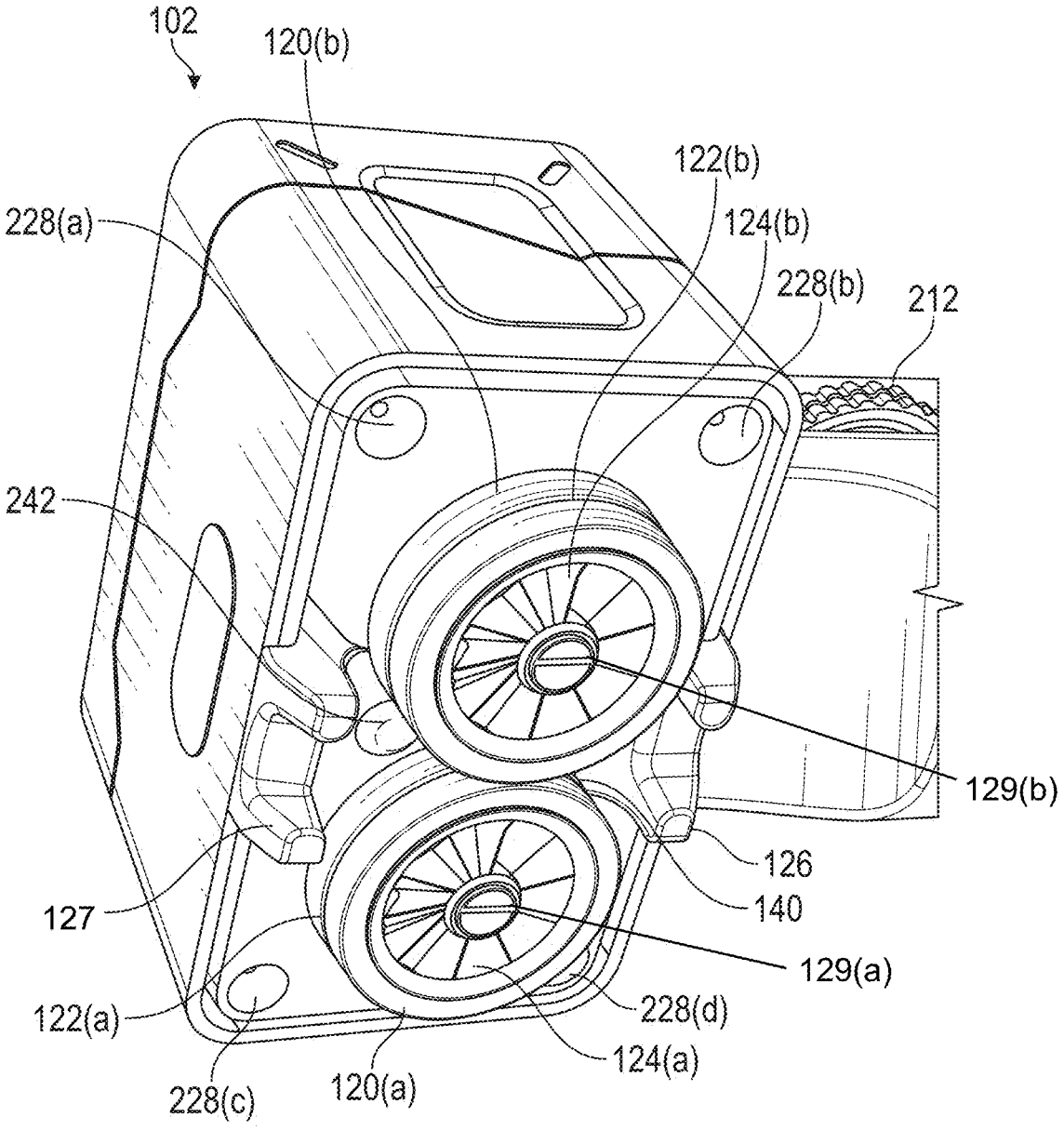
FIG. 14 is a view of a head without a detachable cover in one example.
Figure 15:
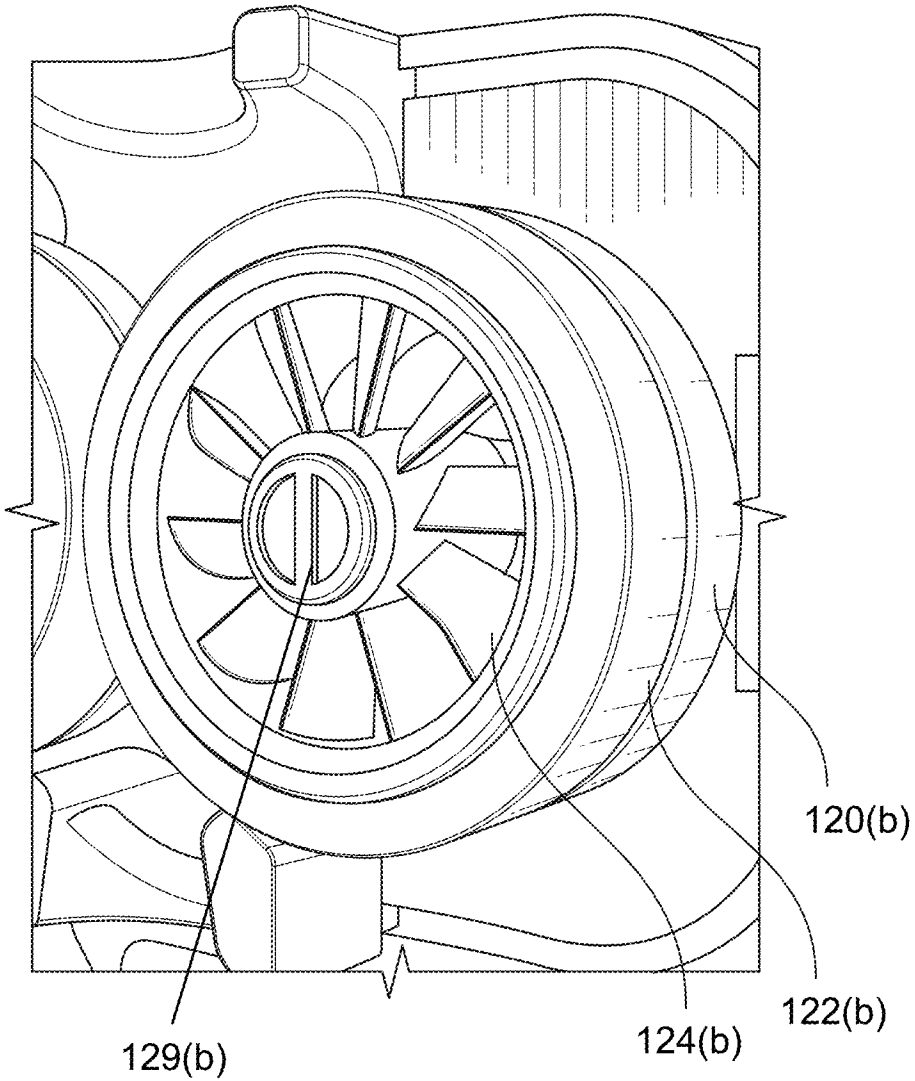
FIG. 15 is a view of a wheel in one example.

As illustrated in FIGS. 13-14, the device 100 can include a first UV light source 118 and a second UV light source 242. The first UV light source 118 can be operable to provide a UV light to the string 150. The first UV light source 118 can be located on an upper exterior surface of the head 102 and can be operable to provide UV light to portions of the string 150 outside of the detachable cover 106. In some examples, the string 150 can be made of a UV reactive material, such as phosphors or a fluorescent dye. The UV light provided by the first UV light source 118 can cause the phosphors or fluorescent dye of the string 150 to illuminate, thereby creating a glowing effect. The first UV light source 118 can have a filter configured to filter the light provided by the first UV light source 118 to a wavelength of about 350 nm to about 380 nm, about 360 nm to about 375 nm, or about 365 nm. The filter can filter the light such that it is invisible to the observer.

The second UV light source 242 can be located proximal the first wheel 120(*a*) and the second wheel 120(*b*), as illustrated, for example, in FIG. 14. The second UV light source 242 can be configured to provide light to a portion of the string 150 inside the detachable cover 106. The second UV light source 242 can also provide excitation light to the detachable cover 106. The second UV light source 242 can provide a UV light at a wavelength of about 315 nm to about 330 nm, about 330 nm to about 345 nm, about 345 nm to about 360 nm, about 360 nm to about 375 nm, about 375 nm to about 390 nm, or about 390 nm to about 400 nm. In some examples, the second UV light source 242 can have a filter configured to filter the light provided by the second UV light source 242 to a wavelength of about 350 nm to about 380 nm, about 360 nm to about 370 nm, or about 365 nm. The filter can filter the light such that it is invisible to an observer. The UV light provided by the second UV light source 242 can cause the phosphors or fluorescent dye of the string 150 to illuminate, thereby creating a glowing effect. When the string 150 comprises phosphors, the second UV light source 242 can charge the phosphors while portions of the string 150 pass through the detachable cover 106. After a period of time, the phosphors emit the light received from the second UV light source 242 thereby creating a glowing effect. In some examples, the first UV light source 118 and the second UV light source 242 can be 3 W UV lamps.

Figure 19:
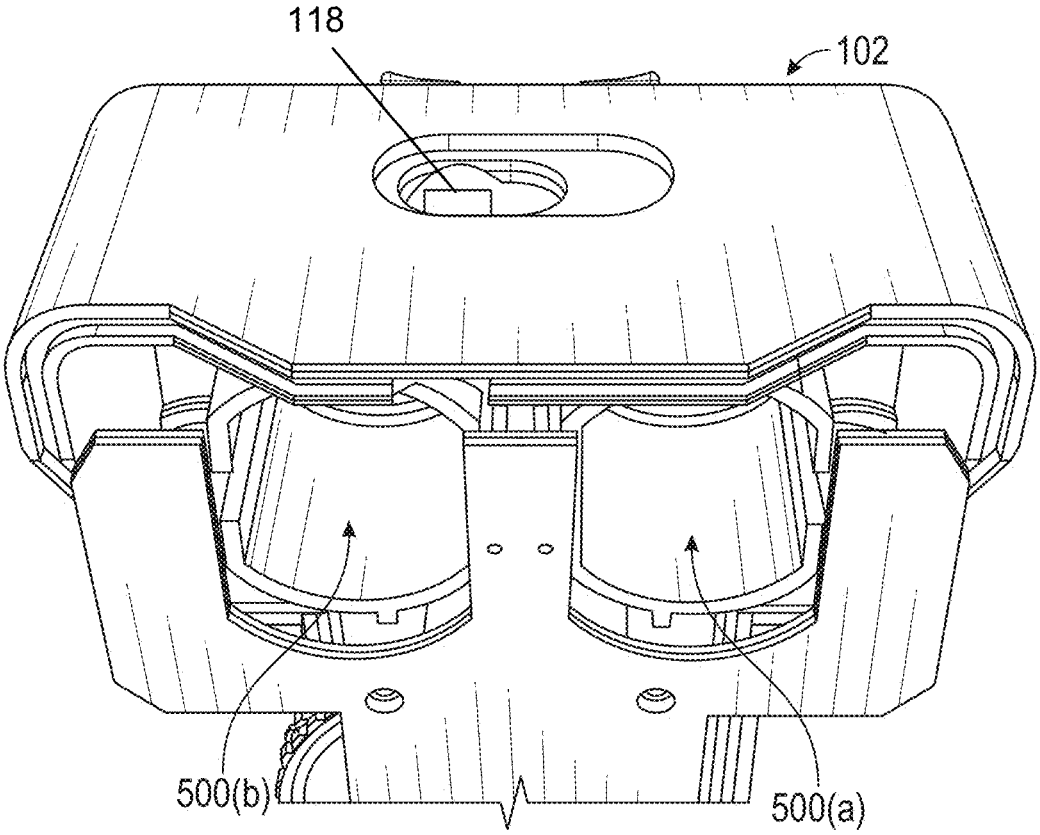
FIG. 19 is a cross sectional view of a device for propelling string in one example.

As illustrated in FIG. 19, the first UV light source 118 can be located offset from a center point of the head 102. By offsetting the first UV light source 118 from the center of the head, the light is emitted at a broad angle, thereby minimizing the area in which the string 150 is not illuminated.

As illustrated in FIG. 14, the head 102 can include one or more attachment mechanisms configured to removably couple to one or more attachment mechanisms of the detachable cover 106. The one or more attachment mechanisms on the head 102 can include a first magnet 228(*a*), a second magnet 228(*b*), a third magnet 228(*c*), and a fourth magnet 228(*d*). As illustrated in FIGS. 20A-20B, the detachable cover 106 can have corresponding attachment mechanisms to removably couple to the one or more attachment mechanisms of the head 102. FIG. 20B illustrates a first magnet 600(*a*) and a second magnet 600(*b*) operable to removably couple to the first magnet 228(*a*) and the second magnet 228(*b*) of the head 102. Similarly, the detachable cover 106 can have a third magnet and a fourth magnet operable to removably couple to the third magnet 228(*c*) and the fourth magnet 228(*d*) of the head 102. It will be appreciated that other attachment mechanisms described herein and/or operable to attach the detachable cover 106 to the head 102 can be used to removably couple the detachable cover 106 to the head 102. Removably coupling the detachable cover 106 to the head 102 provides numerous benefits. For example, if the string 150 becomes tangled within the detachable cover 106, the user can easily remove the cover and untangle the string 150.

Figure 16:
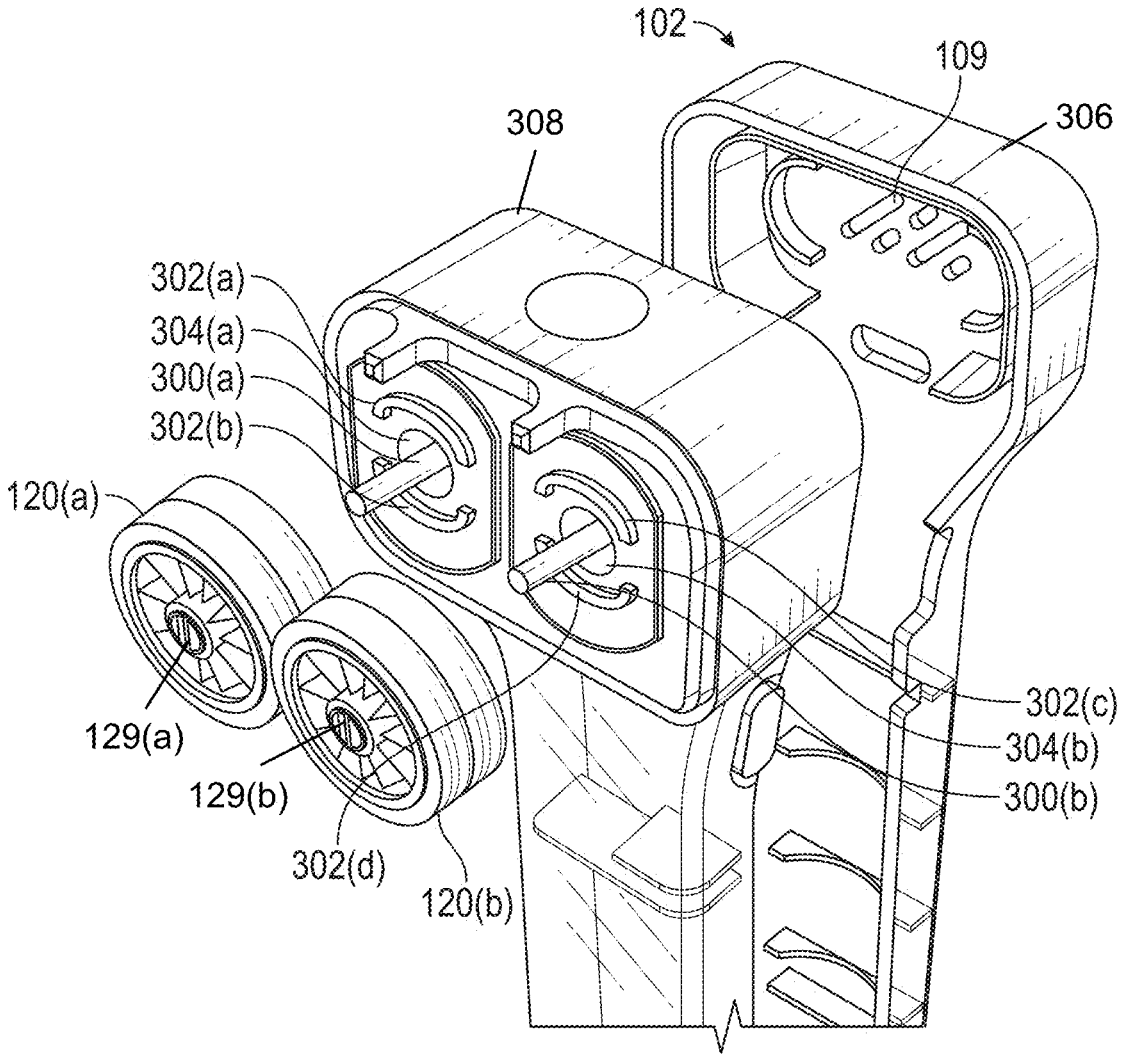
FIG. 16 an exploded view of a device for propelling string in one example.

FIG. 16 illustrates the internal components of the device 100. The device 100 can include a first motor spindle 300(*a*) and a second motor spindle 300(*b*). The cap 129(*a*) of the first wheel 120(*a*) can be configured to couple to the first motor spindle 300(*a*). For example, the cap 129(*a*) can form a friction fit with the first motor spindle 300(*a*), be threaded such that it is screwed to corresponding threads of the first motor spindle 300(*a*), or be coupled using other attachment mechanisms operable to couple the cap 129(*a*) to the first motor spindle 300(*a*). The cap 129(*b*) of the second wheel 120(*b*) can be configured couple to the second motor spindle 300(*b*). For example, the cap 129(*b*) can form a friction fit with the second motor spindle 300(*b*), be threaded such that it is screwed to corresponding threads of the second motor spindle 300(*b*), or be coupled using other attachment mechanisms operable to couple the cap 129(*b*) to the second motor spindle 300(*b*). In this manner, the first wheel 120(*a*) and the second wheel 120(*b*) can be mounted to the first motor spindle 300(*a*) and the second motor spindle 300(*b*) and thereby rotatably mounted to the head 102.

The first motor spindle 300(*a*) and the second motor spindle 300(*b*) can be coupled to at least one motor. In some examples, the at least one motor can include a first motor and a second motor. The first motor and the second motor can be configured to rotate the first motor spindle 300(*a*) and the second motor spindle 300(*b*), thereby rotating the first wheel 120(*a*) and the second wheel 120(*b*). In another example, the first motor spindle 300(*a*) and the second motor spindle 300(*b*) can be coupled to a single motor. The single motor can be operable to rotate the first motor spindle 300(*a*) and the second motor spindle 300(*b*), thereby rotating the first wheel 120(*a*) and the second wheel 120(*b*). In some examples, the first wheel 120(*a*) and the second wheel 120(*b*) can be rotated in opposite directions. For example, the first wheel 120(*a*) can be rotated counterclockwise and the second wheel 120(*b*) can be rotated clockwise or vice versa.

Figure 18:
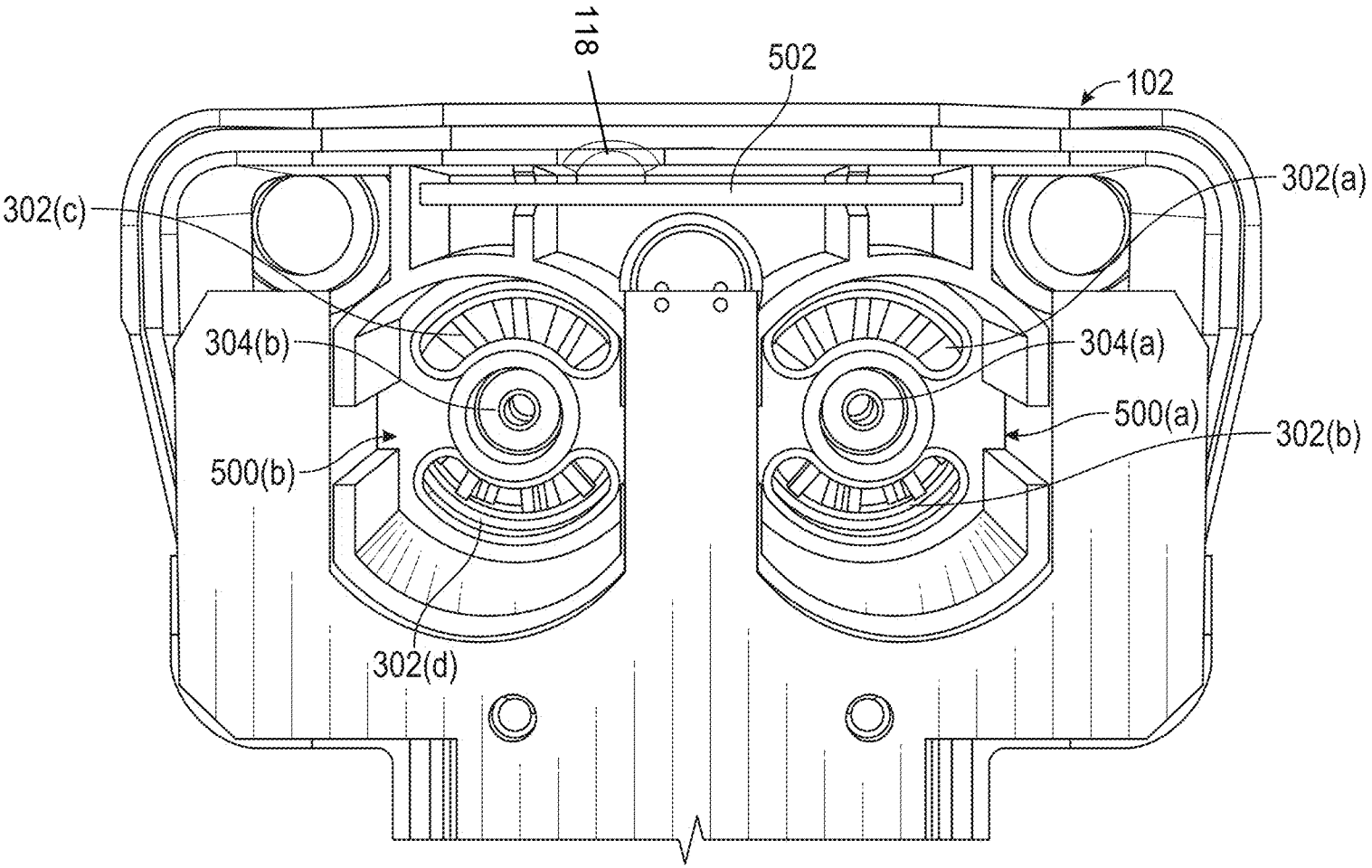
FIG. 18 is a cross sectional view of a device for propelling string in one example.

As illustrated in FIGS. 16 and 18, the device 100 can further include air inlets operable to receive air pulled in from the exterior environment by the interior fan blades 124(*a*), 124(*b*) of the wheels. In an example, the head 102 can include air inlets 302(*a*), 302(*b*), 302(*c*), 302(*d*), 304(*a*), 304(*b*) for allowing air to enter into the interior of the device 100.

As illustrated in FIGS. 18-19, the head 102 can include two cavities. The head 102 can include a first cavity 500(*a*) and a second cavity 500(*b*). The first cavity 500(*a*) can be operable to contain the first motor for rotating the first wheel 120(*a*). The second cavity can be operable to contain the second motor for rotating the second wheel 120(*b*). In another example, the head 102 can include a single cavity operable to contain a single motor. The single motor can drive (e.g., rotate) both the first motor spindle 300(*a*) and the second motor spindle 300(*b*) and thereby drive (e.g., rotate) the first wheel 120(*a*) and the second wheel 120(*b*).

As illustrated in FIG. 18, the head 102 can further include an aluminum circuit board 502. The first UV light source 118 can be connected to the aluminum circuit board 502. In an example, the first UV light source 118 can be soldered to the aluminum circuit board 502. In another example, both the first UV light source 118 and the second UV light source 242 can be soldered to the aluminum circuit board 502. The aluminum circuit board 502 can act as a heat sink, pulling heat generated by the first UV light source 118 and/or the second UV light source 242 into the air flow provided by the interior fan blades 124(*a*), 124(*b*). It will be appreciated that the aluminum circuit board 502 can be made of different materials known in the art operable to act as heat sinks.

As illustrated in FIGS. 15-18, the device 100 can include a cooling system. The cooling system can include the interior fan blades 124(*a*), 124(*b*) of the first wheel 120(*a*) and the second wheel 120(*b*), the one or more front vents 108 or the first vent 208(*a*) and the second vent 208(*b*) of the detachable cover 106, the aluminum circuit board 502, the air inlets 302(*a*), 302(*b*), 302(*c*), 302(*d*), 304(*a*), 304(*b*), and the one or more rear vents 109 or one or more rear vents 209. When the first wheel 120(*a*) and the second wheel 120(*b*) are being driven by the motors, the interior fan blades 124(*a*), 124(*b*) pull air through the one or more front vents 108 or the first vent 208(*a*) and the second vent 208(*b*). The air flows through the air inlets 302(*a*), 302(*b*), 302(*c*), 302(*d*), 304(*a*), 304(*b*) of the head 102 and into the interior of the head 102. As the first wheel 120(*a*) and the second wheel 120(*b*) are continuously driven, air is continuously pulled into the head 102. The air can then flow by the motors and the aluminum circuit board 502 and carry heat away from the motors and the aluminum circuit board 502. The air can be expelled from the head 102 of the device 100 at the one or more rear vents 109 or one or more rear vents 209.

Figure 17:
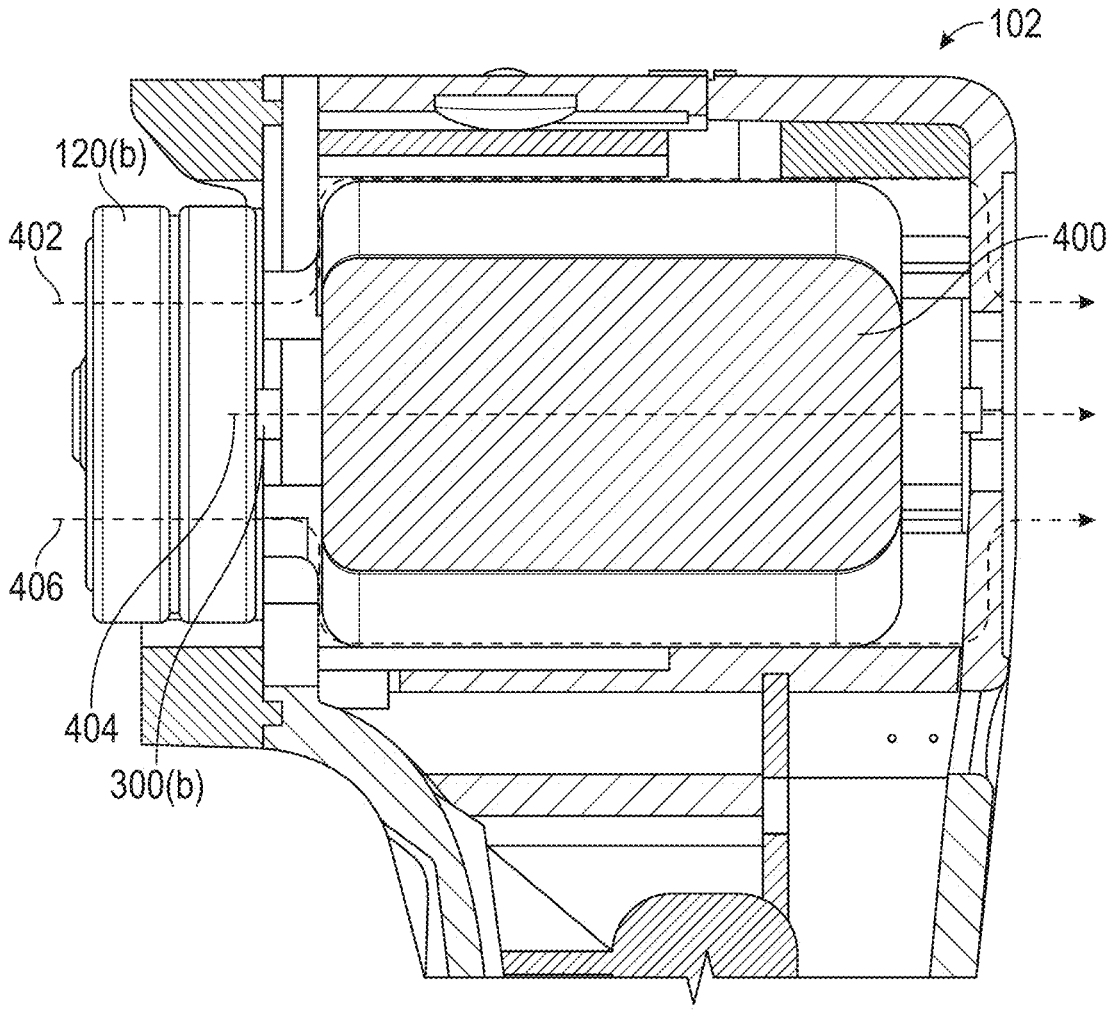
FIG. 17 is a cross sectional view of a device for propelling string in one example.

FIG. 17 illustrates the air flow path. Air can flow along a first air flow path 402, a second air flow path 404, and a third air flow path 406. The air can enter the device through the air inlets 302(*a*), 302(*c*) and flow around an upper surface of a first motor 400 and a second motor (not shown) and then be expelled out the one or more rear vents 109 or one or more rear vents 209 in the first air flow path 402. The first air flow path 402 can also carry heat out the one or more rear vents 209 from the aluminum circuit board 502. In the second air flow path 404, air can flow through air inlets 304(*a*), 304(*b*) around the first motor 400 and the second motor (not shown) and then be expelled out the one or more rear vents 109 or one or more rear vents 209. In the third air flow path 406, air can flow through the air inlets 302(*b*), 302(*d*) and flow around a lower surface of the first motor 400 and the second motor (not shown) and then be expelled out the one or more rear vents 109 or one or more rear vents 209. In this manner, the motors, UV light sources, and other internal components of the device 100 can be kept at a regulated operating temperature, thereby extending battery life and preventing the device 100 from overheating. In some examples, the cooling system can further include one or more heat sinks proximal the motor or motors and air can be passed by these heat sinks to further cool the motor or motors.

Figure 22:
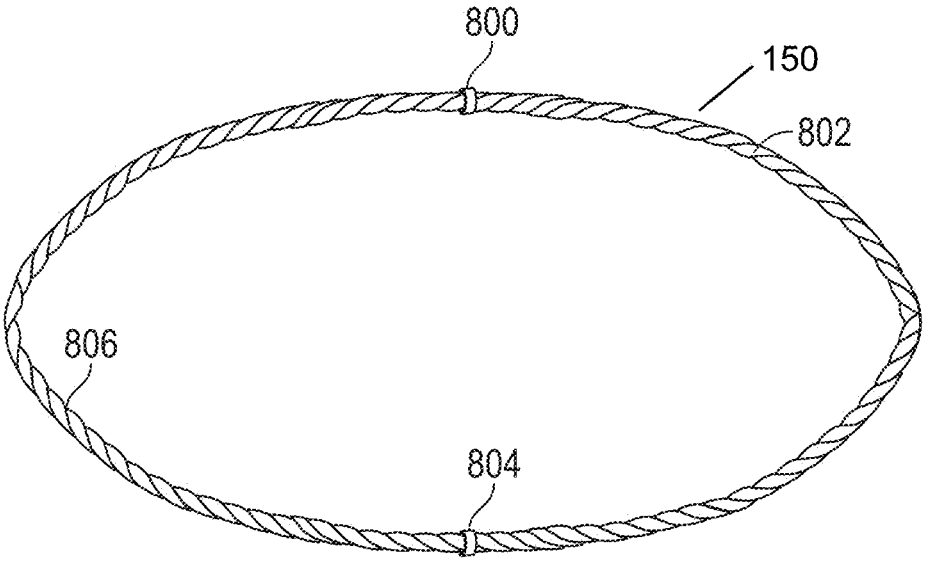
FIG. 22 is a view of a looped string in one example.
Figure 23:
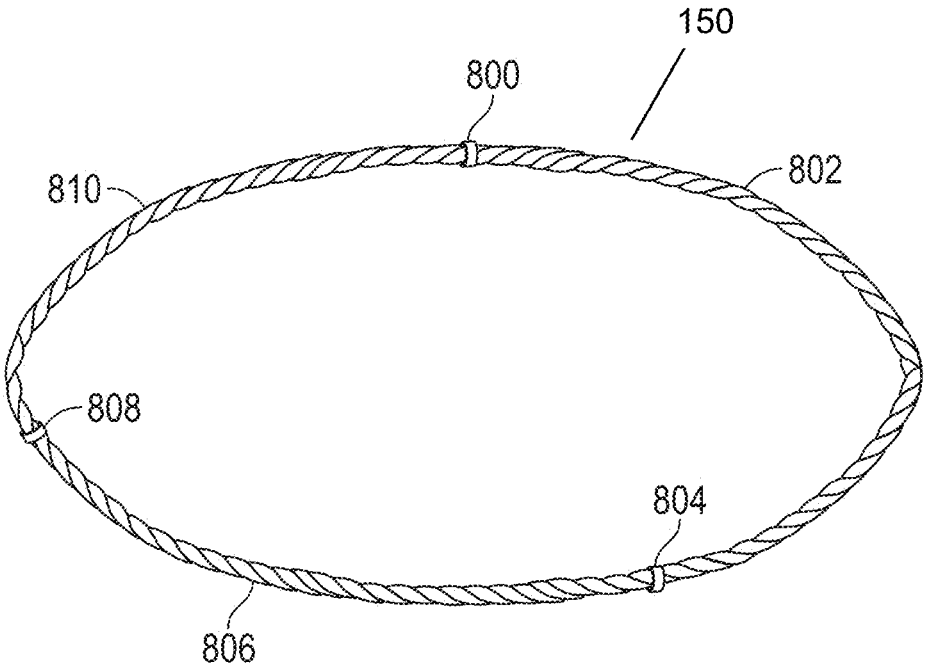
FIG. 23 is a view of a looped string in one example.

FIGS. 21-23 illustrate the string 150. The string 150 can be a looped string as illustrated, for example, in FIGS. 22-23. The string 150 can comprise a mixture of cotton and polyester materials. The polyester can melt under a high temperature heat treatment, thereby providing a connection point between ends of the string to create a looped string. The cotton material can reduce the weight of the string and provide sufficient friction and surface texture to be propelled into the air, thereby creating a levitating effect. As illustrated in FIG. 21, the string 150 can have a first end and a second end that are permanently coupled at a connection point 700. While the connection point 700 is shown in FIGS. 21-23, the connection point 700 can be invisible to the human eye and is substantially the same diameter as the string 150. The connection point is seamless, thereby preventing clicking noises or bouncing when the string 150 is being propelled by the first wheel 120(*a*) and the second wheel 120(*b*). In some examples, the looped string can have a total length of about 1 foot to about 10 feet or any length therebetween.

The string 150 can have two ends, a first end 702 and a second end 704. The ends of the string can be placed in a mold. The mold can be configured such that heat is transferred to the interior of the mold, but the mold does not melt or otherwise change in shape. Heat can be provided to the mold to melt the polyester in the first end 702 and the second end 704. In some examples, the temperature can be about 245 degrees C. (Celsius) to about 265 degrees C., about 265 degrees C. to about 285 degrees C., about 285 degrees C. to about 305 degrees C., about 305 degrees C. to about 325 degrees C., about 345 degrees C. to about 365 degrees C., about 365 degrees C. to about 385 degrees C., or about 385 degrees C. to about 400 degrees C. The mold can maintain the shape of the string 150 such that the connection point 700 has the same diameter or substantially the same diameter as the remainder of the string. Once the polyester in the first end 702 and the second end 704 is melted in the mold, the mold can be cooled, thereby cooling the polyester at the connection point 700 and permanently connecting the first end 702 and the second end 704. In some examples, when the first end 702 and the second end 704 are melted in the mold, a force or pressure can be applied to form the connection point 700 having a desired diameter (e.g., a diameter substantially equal to the diameter of the remaining portions of the string). In this manner, the first end 702 and the second end 704 create a seamless connection and the looped string is formed.

In an example, the mold can maintain the diameter of the connection point 700 below the diameter of the gap 140 between the first wheel 120(*a*) and the second wheel 120(*b*). In some examples, the mold can maintain the diameter of the connection point 700 at a maximum diameter of about 0.5 mm to about 0.6 mm. The gap 140 between the first wheel 120(*a*) and the second wheel 120(*b*) can be configured to have a maximum diameter of 0.7 mm, thereby preventing any clicking caused by the connection point when the string is being propelled through the air by the device 100. Additionally, maintaining the diameter of the connection point 700 below the diameter of the gap 140 stabilizes the string 150 motion through the air preventing any bouncing or unwanted movement of the string 150. An exemplary system and methods for forming the string 150 is further described herein.

As illustrated in FIGS. 22-23, the string 150 can comprise multiple strings. As illustrated in FIG. 22, the string 150 can comprise a first string 802 and a second string 806. The first string 802 can have two ends, a first end and a second end. The first end and the second end of the first string 802 can be permanently coupled to a first end and a second end of the second string 806 at connection points 800, 804 using the string connection methods described herein. As illustrated in FIG. 23, the string can comprise a first string 802, a second string 806, and a third string 810. The ends of the first string 802, second string 806, and third string 810 can be permanently coupled at connection points 800, 804, 808 using the string connection systems and methods described herein.

The first string 802 and the second string 806 can further include UV reactive materials. The first string 802 and the second string 806 can be dyed with fluorescent dyes that, when provided UV light, illuminate in different colors. When the strings are provided light by the first UV light source 118 and/or the second UV light source 242, the strings can illuminate in different colors thereby producing a flashing visual effect when propelled through the air. The flashing visual effect can appear to an observer as instantaneous color transitions of the string. Similarly, the first string 802, second string 806, and third string 810 can by dyed with fluorescent dyes that, when provided UV light, illuminate in different colors. In some examples, 4, 5, 6, 7, 8, 9, 10, or more different strings can be connected using the string connection systems and methods described herein and all of the strings or some of the strings can include UV reactive materials.

In another example, the UV reactive material can be a phosphorescent material (e.g., phosphors). The phosphorescent material can be provided UV light by the first UV light source 118 and/or the second UV light source 242. The second UV light source 242 can provide excitation light to the portions of the string 150 in the detachable cover 106 and the string can later illuminate. Similar to the fluorescent strings, the phosphorescent strings can be combined in different illumination colors and multiple strings can be used. In some examples, the phosphors in the string 150 are charged as the phosphors pass the second UV light source 242 within the detachable cover 106. The phosphors can have a delayed illumination time such that the phosphors begin illuminating once the phosphors in the string 150 are outside of the detachable cover 106. In this manner, the visual illumination of the phosphors can occur without the need for UV light from the first UV light source 118 (e.g., external UV light source). By charging the phosphors within the detachable cover 106 with the second UV light source 242, an observer may be surprised that the string 150 enters the detachable cover 106 with no illumination and exits the detachable cover 106 illuminated. Further, the charging of the phosphors by the second UV light source 242 can allow for a visual effect in low-light conditions without the need for the first UV light source 118 to provide excitation light (e.g., first UV light source 118 is turned off or not included in the device 100).

In some examples, the phosphors in the string 150 remain charged with the excitation light, and thereby remain illuminated, after the second UV light source 242 is turned off. In this manner, observers may be surprised by the continued illumination of the string 150 when there is no excitation light being provided by either the first UV light source 118 or the second UV light source 242.

In some examples, the looped string can include multiple strings each having different UV reactive materials that illuminates in a different color. For example, the multiple strings can be arranged in a rainbow pattern, a two color alternating pattern, a three color alternating pattern, a four color alternating pattern, or combinations thereof.

Figure 12:
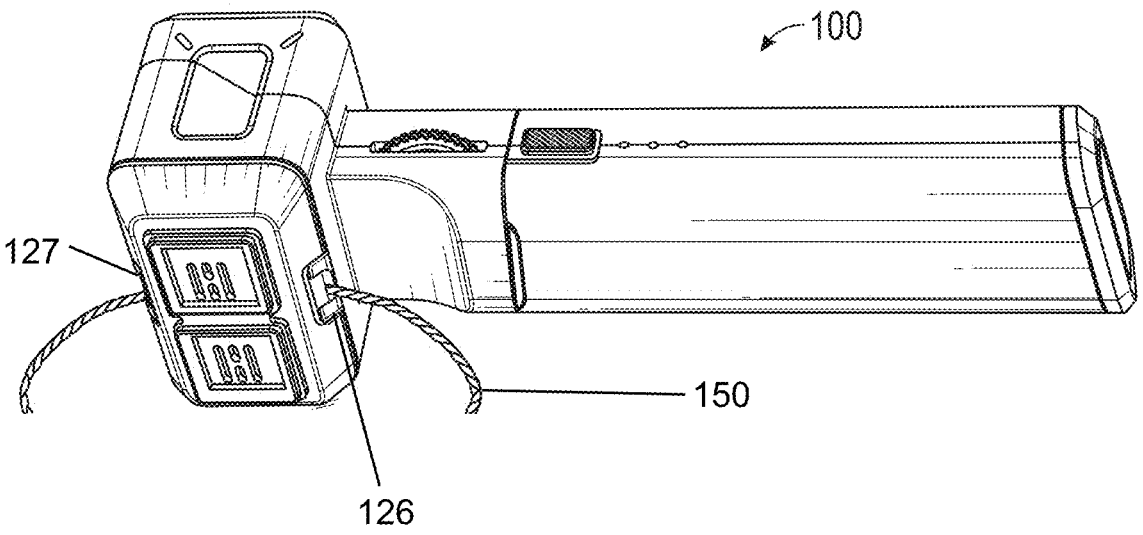
FIG. 12 is an isometric view of a device for propelling string in one example.

As illustrated in FIGS. 1 and 12, the string 150 can be attached to the device 100. As described herein, the string 150 is connected to the device utilizing the gap 140 between the first wheel 120(*a*) and the second wheel 120(*b*), the upper U-shaped projection 127 and the lower U-shaped projection 126, and the detachable cover 106. When the string 150 is connected to the device, the string 150 can be propelled in the air and appear to levitate. The speed at which the string 150 is propelled by the first wheel 120(*a*) and the second wheel 120(*b*) can cause the string 150 to be suspended in the air. A user can move the handle 104 in their hand to make different shapes and patterns with the string 150. Further, the fluorescent dyes used on the string can provide a flashing color effect, thereby making the string 150 to appear to instantaneously change color.

Further provided herein is a string propelling kit. The string propelling kit can include one or more of the looped strings described herein, any of the devices described herein, and a packaging.

FIGS. 25A-25F illustrate a system 2500 for forming the strings described herein. The system 2500 can be operable to form a single continuous string from two or more pieces of string and/or form a looped string from a single piece of string or two or more pieces of string. For example, the system 2500 can receive two ends of a string or pieces of string and connect the ends of the string or pieces of string. The system 2500 can connect the ends by providing heat to the ends, thereby melting the ends. The system 2500 can then move the melted ends together such that the ends touch within a mold or other mechanism. The system 2500 can then provide a compression force to the ends, thereby connecting the melted ends and forming a single string. In some examples, the melted ends are connected at a connection point. The connection point can have substantially the same diameter as the remainder of the string such that the entire string has a consistent and uniform diameter.

Figure 25A:
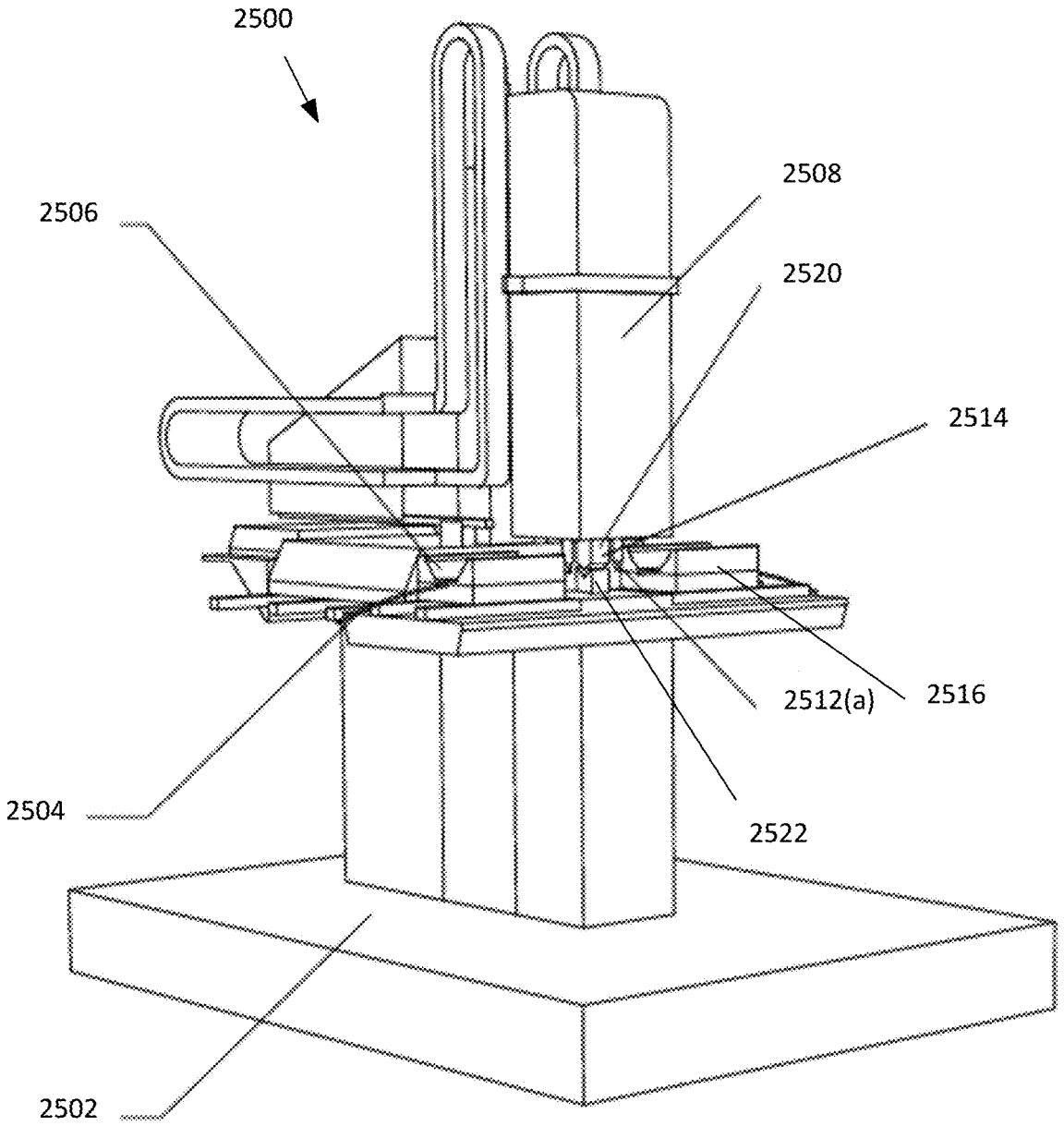
FIG. 25A illustrates a system for forming strings in one example.

As illustrated in FIGS. 25A-25F, the system 2500 can include a first string holding mechanism 2506, a second string holding mechanism 2516, a drive arm 2508, a compression mechanism 2514, a base 2502, and at least one heat device (e.g., first heat device 2512(*a*)). FIG. 25A illustrates a first string 2504 secured in the first string holding mechanism 2506. The first string holding mechanism 2506 and the second string holding mechanism 2516 can each be operable to secure a string within the system 2500. The first string holding mechanism 2506 and the second string holding mechanism 2516 can each secure a string such that an end of each string extends outside of the first string holding mechanism 2506 and the second string holding mechanism 2516. In some examples, the first string holding mechanism 2506 can be any kind of mechanism operable to secure a string such that the string does not move, translate, or slide in relation to the first string holding mechanism 2506. The second string holding mechanism 2516 can be any kind of mechanism operable to secure a string such that the string does not move, translate, or slide in relation to the second string holding mechanism 2516. In some examples, the first string holding mechanism 2506 and the second string holding mechanism 2516 can be clamps or other mechanisms operable to secure a string.

Figure 25B:
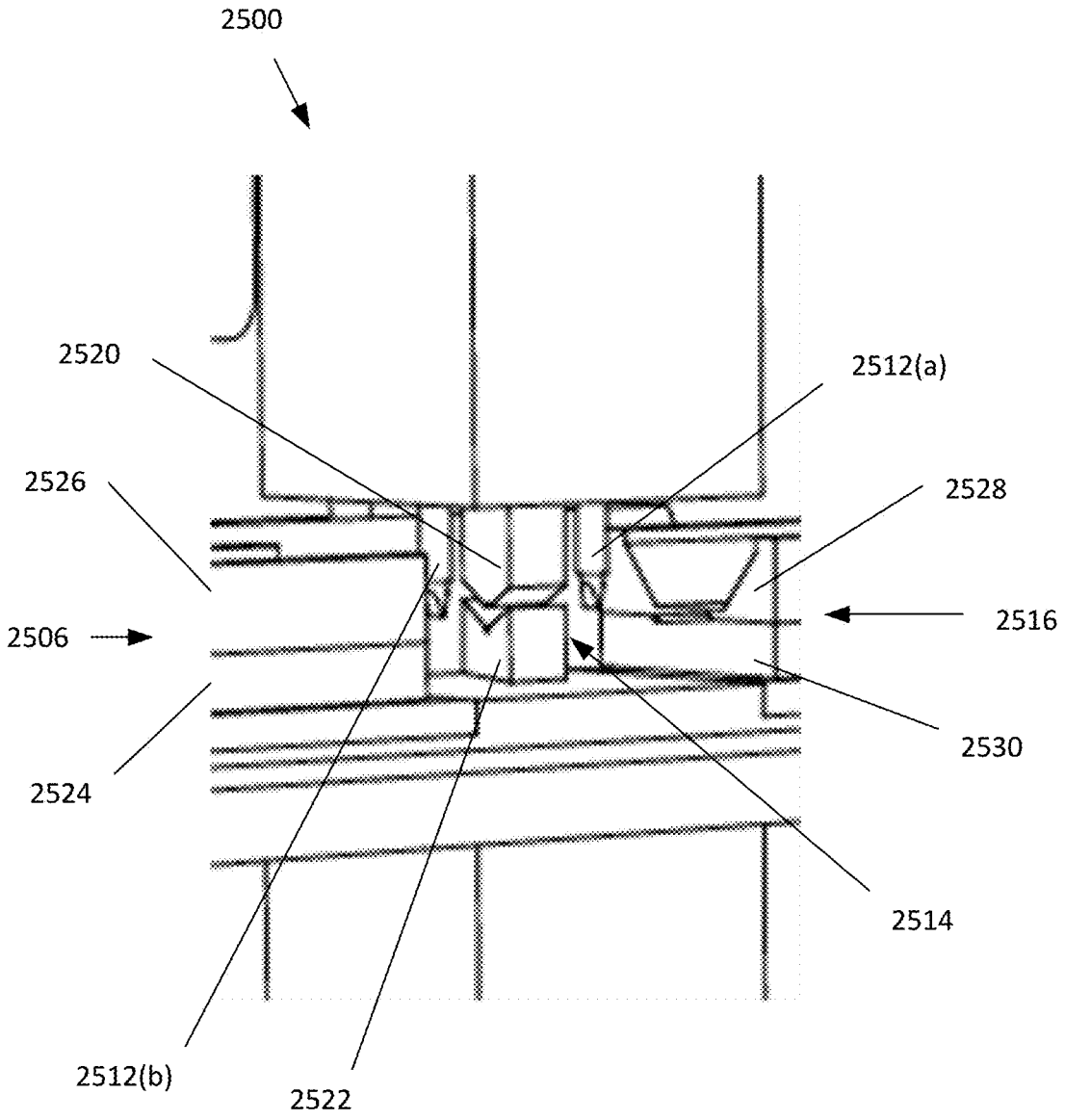
FIG. 25B illustrates a close up view of a system for forming strings in one example.

FIG. 25B illustrates a close up view of the system 2500. As illustrated, the first string holding mechanism 2506 can include a first holding mechanism upper portion 2526 and a first holding mechanism lower portion 2524. The first holding mechanism upper portion 2526 and/or the first holding mechanism lower portion 2524 can be vertically moveable within the system 2500. For example, the first holding mechanism upper portion 2526 can be operable to be moved vertically upward or downward. Similarly, the first holding mechanism lower portion 2524 can be operable to be moved vertically upward or downward. When a string is placed between the first holding mechanism upper portion 2526 and the first holding mechanism lower portion 2524, the first holding mechanism upper portion 2526 and/or the first holding mechanism lower portion 2524 are moved such that the first holding mechanism upper portion 2526 contacts the first holding mechanism lower portion 2524 and the string is secured therein. In some examples, the first holding mechanism lower portion 2524 is not vertically moveable.

The second string holding mechanism 2516 can include a second holding mechanism upper portion 2528 and a second holding mechanism lower portion 2530. The second holding mechanism upper portion 2528 and/or the second holding mechanism lower portion 2530 can be vertically moveable within the system. For example, the second holding mechanism upper portion 2528 can be operable to be moved vertically upward or downward. Similarly, the second holding mechanism lower portion 2530 can be operable to be moved vertically upward or downward. When a string is placed between the second holding mechanism upper portion 2528 and the second holding mechanism lower portion 2530, the second holding mechanism upper portion 2528 and/or the second holding mechanism lower portion 2530 are moved such that the second holding mechanism upper portion 2528 contacts the second holding mechanism lower portion 2530 and the string is secured therein. In some examples, the second holding mechanism lower portion 2530 is not vertically moveable.

The system 2500 can include at least one heat device. The at least one heat device can be operable to provide heat to the ends of the one or more strings, thereby melting the one or more strings. In some examples, the heat provided is heated air or gas which has a temperature at or above the melting point of the one or more strings such that the end of the string is melted by the at least one heat device. The at least one heat device can be located between the first string holding mechanism 2506 and the second string holding mechanism 2516, such that two ends of a single string or an end of a first string and the end of a second string can be provided heat and thereby melted. In some examples, the system can include a first heat device 2512(*a*) and a second heat device 2512(*b*). The first heat device 2512(*a*) can be operable to provide heat to an end of a string secured in the second string holding mechanism 2516. The second heat device 2512(*b*) can be operable to provide heat to an end of a string secured in the first string holding mechanism 2506.

The system can include a compression mechanism 2514. The compression mechanism 2514 can be operable to provide a pressure or force to the melted ends of the strings, thereby combining the ends of two strings to form a single continuous string. In some examples, the compression mechanism 2514 can include a mold within the compression mechanism. For example, the two melted ends to be combined can be placed in the mold portion, then a pressure or force can be provided by the compression mechanism 2514, thereby forming a continuous string. In some examples, the mold can have substantially the same diameter as the string such that when the melted ends are combined the single continuous string has a consistent and uniform diameter.

In at least one example, the compression mechanism 2514 can be located between the first heat device 2512(*a*) and the second heat device 2512(*b*). In some examples, the compression mechanism 2514 can be located between the first string holding mechanism 2506 and the second string holding mechanism 2516. In some examples, the compression mechanism 2514 can also be a heat device, such that the at least one heat device and the compression mechanism 2514 are the same component. When the at least one heat device and the compression mechanism 2514 are the same component, the compression mechanism 2514 can be located between the first string holding mechanism 2506 and the second string holding mechanism 2516.

As illustrated in FIGS. 25A-25F, the compression mechanism 2514 can include an upper compression component 2520 and a lower compression component 2522. The upper compression component 2520 and the lower compression component 2522 can be operable to connect the melted ends of the string or strings. For example, the upper compression component 2520 and the lower compression component 2522 can provide a pressure or a force to the melted ends of the string or strings, thereby forming a continuous string. In some examples, the upper compression component 2520 and/or the lower compression component 2522 can be vertically moveable. For example, the upper compression component 2520 can be operable to be moved upward or downward within the system 2500. Similarly, the lower compression component 2522 can be operable to be moved upward or downward within the system 2500. In some examples, the lower compression component 2522 is vertically fixed within the system 2500 (e.g., the lower compression component 2522 is not operable to be moved vertically within the system 2500).

As illustrated in FIG. 25A-25F, in some examples, the upper compression component 2520 and the lower compression component 2522 can be V-shaped fixtures (e.g., V-shaped mold). In some examples, the upper compression component 2520 and the lower compression component 2522 can form a mold when the upper compression component 2520 and the lower compression component 2522 contact each other. In some examples, the melted ends of the string or strings can be loaded into the V-shaped portion of the lower compression component 2522. Once the melted ends are loaded into the V-shaped portion of the lower compression component 2522, the upper compression component 2520 can be moved downward, thereby providing a force or pressure to connect the melted ends. In some examples, the V-shaped portion of the lower compression component 2522 has a channel at the bottom of the V-shape (e.g., portion of the V-shape furthest away from the upper compression component 2520). In some examples, the channel has a diameter substantially the same as the diameter of the string or strings such that when a force or pressure is provided by the upper compression component 2520, the melted ends are connected thereby forming a single string having a substantially uniform and consistent diameter.

In some examples, the upper compression component 2520 and the lower compression component 2522 can each have a half circle mold on a contacting surface (e.g., the surface of the upper compression component 2520 that contacts the surface of the lower compression component 2522). The melted ends of the string or strings can be loaded into the half circle mold of the lower compression component 2522 such that when the upper compression component 2520 moves into contact with the lower compression component 2522 the melted ends are combined to form a single string. In some examples, the half circles combine to form a diameter equal to the diameter of the string or strings such that the melted ends connect to have substantially the same diameter as the string or strings.

Figure 25C:
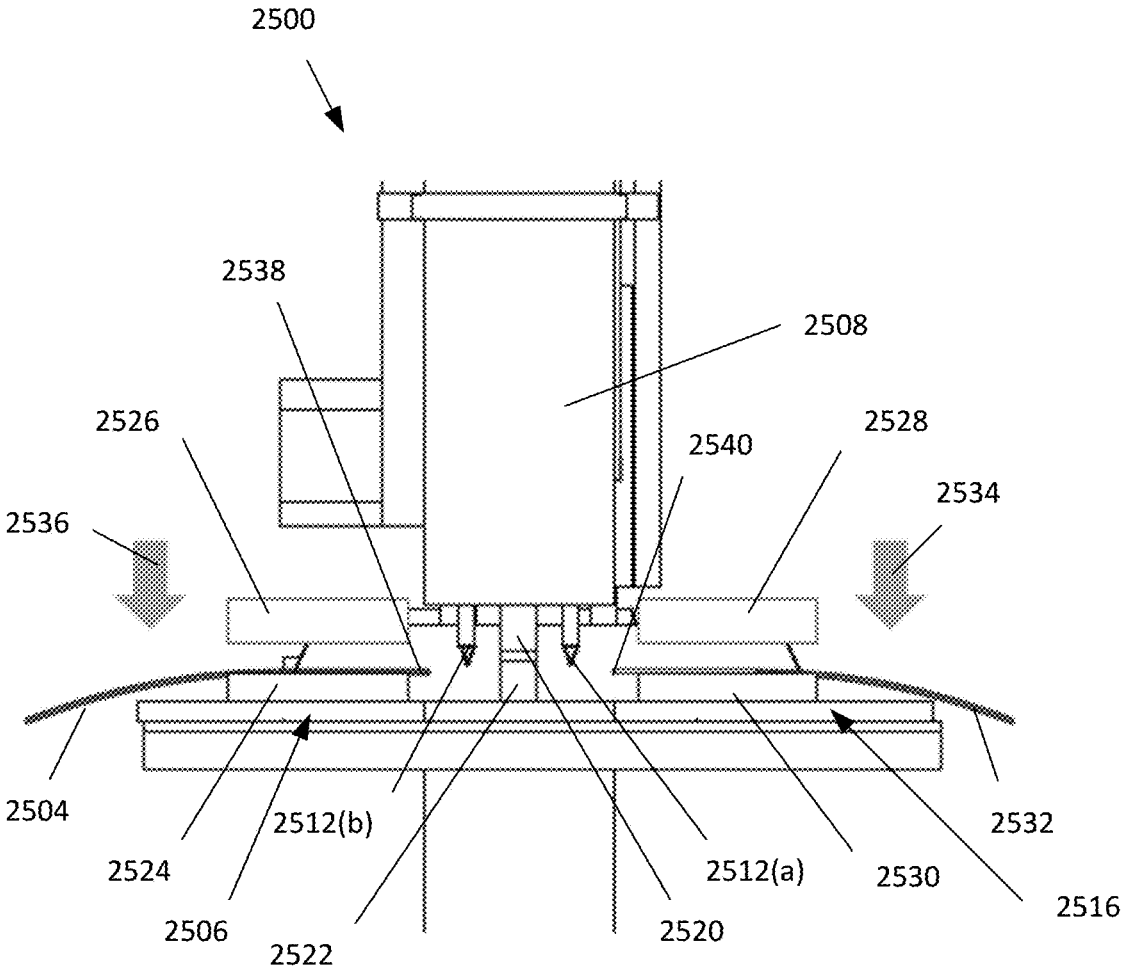
FIG. 25C illustrates a system for forming strings in a loading position in one example.

FIG. 25C illustrates the system 2500 in a loading position. In the loading position, the first holding mechanism upper portion 2526 can be in a vertically raised position (e.g., the first holding mechanism upper portion 2526 is not in contact with the first holding mechanism lower portion 2524). A first string 2504 can be loaded into the first string holding mechanism 2506 by placing the first string 2504 onto the first holding mechanism lower portion 2524. As illustrated in FIG. 25C, the first string 2504 can have an end 2538 that extends out from the first string holding mechanism 2506 towards the second heat device 2512(*b*), thereby allowing the end 2538 to be provided heat by the second heat device 2512(*b*). Once the first string 2504 is properly positioned (e.g., with the end 2538 extending longitudinal outward from the first string holding mechanism 2506 towards the second heat device 2512(*b*)), the first holding mechanism upper portion 2526 can be vertically lowered to contact the first holding mechanism lower portion 2524 as illustrated by arrow 2536. In some examples, the first holding mechanism upper portion 2526 can be slidably coupled to a guide rail operable to allow vertical motion of the first holding mechanism upper portion 2526. In some examples, the first holding mechanism upper portion 2526 can be manually slid or moved by an operator along the guide rail to contact the first holding mechanism lower portion 2524. In some examples, the first holding mechanism upper portion 2526 can be vertically positioned along the guide rail using a motor or actuator in communication with a controller. In some examples, the first holding mechanism upper portion 2526 can have a securing mechanism (e.g., snap-fit mechanism, magnetic mechanism, etc.) operable to secure the first holding mechanism upper portion 2526 to a corresponding securing mechanism of the first holding mechanism lower portion 2524, thereby securing the first string 2504 within the first string holding mechanism 2506.

In the loading position, the second holding mechanism upper portion 2528 can be in a vertically raised position (e.g., the second holding mechanism upper portion 2528 is not in contact with the second holding mechanism lower portion 2530). A second string 2532 can be loaded into the second string holding mechanism 2516 by placing the second string 2532 onto the second holding mechanism lower portion 2530. As illustrated in FIG. 25C, the second string 2532 can have an end 2540 that extends out from the second string holding mechanism 2516 towards the first heat device 2512(*a*), thereby allowing the end 2540 to be provided heat by the first heat device 2512(*a*). Once the second string 2532 is properly positioned (e.g., with the end 2540 extending longitudinal outward from the second string holding mechanism 2516 towards the first heat device 2512(*a*)), the second holding mechanism upper portion 2528 can be vertically lowered to contact the second holding mechanism lower portion 2530 as illustrated by arrow 2534. In some examples, the second holding mechanism upper portion 2528 can be slidably coupled to a guide rail operable to allow vertical motion of the second holding mechanism upper portion 2528. In some examples, the second holding mechanism upper portion 2528 can be manually slid or moved by an operator along the guide rail to contact the second holding mechanism lower portion 2530. In some examples, the second holding mechanism upper portion 2528 can be vertically positioned along the guide rail using a motor or actuator in communication with a controller. In some examples, the second holding mechanism upper portion 2528 can have a securing mechanism (e.g., snap-fit mechanism, magnetic mechanism, etc.) operable to secure the second holding mechanism upper portion 2528 to a corresponding securing mechanism of the second holding mechanism lower portion 2530, thereby securing the second string 2532 within the second string holding mechanism 2516.

Figure 25D:
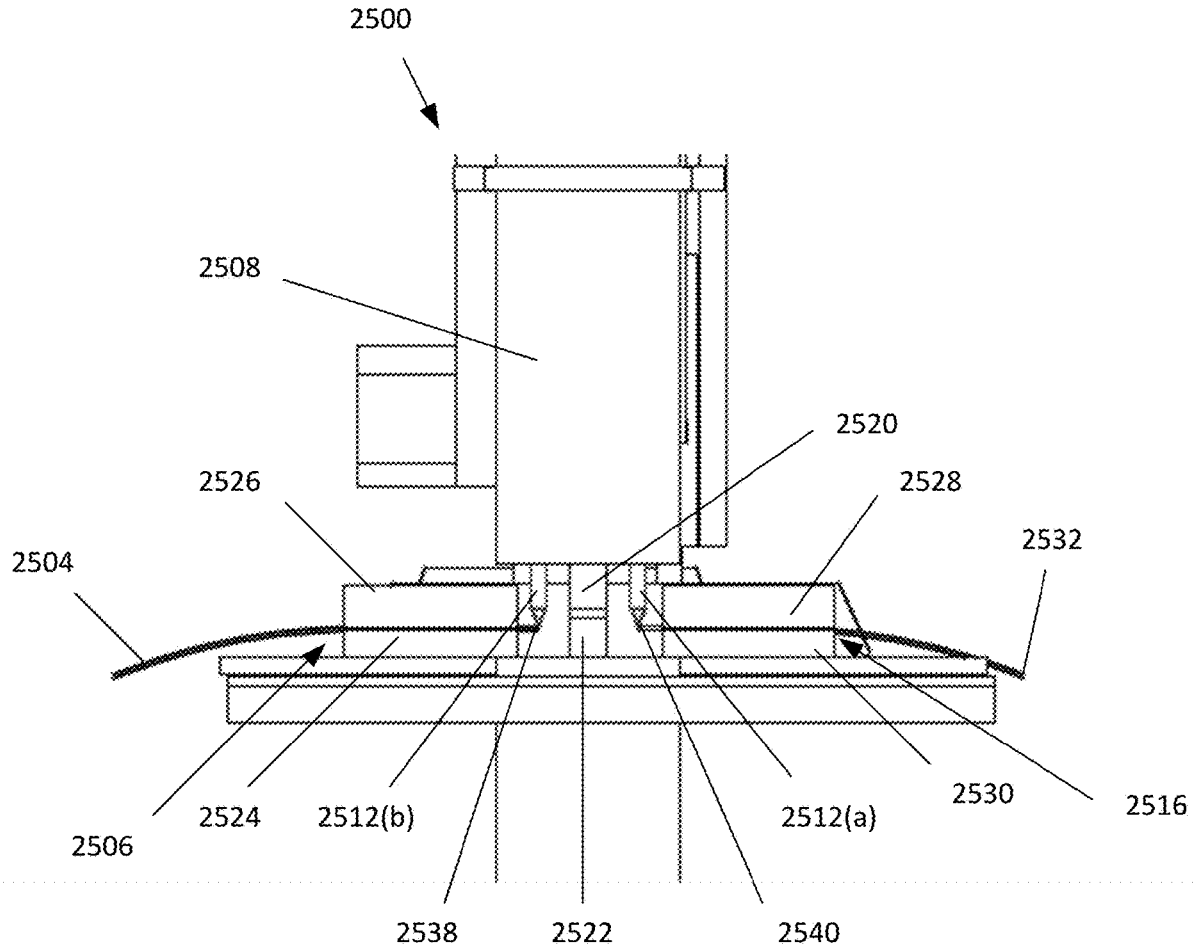
FIG. 25D illustrates a system for forming strings in a heating position in one example.

FIG. 25D illustrates the system 2500 in a heating position. In the heating position, the first string holding mechanism 2506 moves, with the secured first string 2504, longitudinally towards the second heat device 2512(*b*) such that the end 2538 of the first string 2504 is aligned with the second heat device 2512(*b*). In some examples, the first string holding mechanism 2506 is slidably coupled to a guide rail such that the first string holding mechanism 2506 is longitudinally moveable through the system 2500. In some examples, other mechanisms can be used to allow the first string holding mechanism 2506 to be longitudinally moveable through the system 2500. In some examples, an operator can manually move the first string holding mechanism 2506 towards the second heat device 2512(*b*) to align the end 2538 with the second heat device 2512(*b*). In some examples, the first string holding mechanism 2506 can be moved towards the second heat device 2512(*b*) via a motor or actuator in communication with a controller. Once the end 2538 of the first string 2504 is aligned with the second heat device 2512(*b*), the second heat device 2512(*b*) can provide heat (e.g., heated air or gas) to the end 2538, thereby melting the material at the end 2538 of the first string 2504.

Similarly, in the heating position illustrated in FIG. 25D, the second string holding mechanism 2516 moves, with the secured second string 2532, longitudinally towards the first heat device 2512(*a*) such that the end 2540 of the second string 2532 is aligned with the first heat device 2512(*a*). In some examples, the second string holding mechanism 2516 is slidably coupled to a guide rail such that second string holding mechanism 2516 is longitudinally moveable through the system 2500. In some examples, other mechanisms can be used to allow the second string holding mechanism 2516 to be longitudinally moveable through the system 2500. In some examples, an operator can manually move the second string holding mechanism 2516 towards the first heat device 2512(*a*) to align the end 2540 with the first heat device 2512(*a*). In some examples, the second string holding mechanism 2516 can be moved towards the first heat device 2512(*a*) via a motor or actuator in communication with a controller. Once the end 2540 of the second string 2532 is aligned with the first heat device 2512(*a*), the first heat device 2512(*a*) can provide heat (e.g., heated air or gas) to the end 2540, thereby melting the material at the end 2540 of the second string 2532.

The first heat device 2512(*a*) and the second heat device 2512(*b*) can be controlled by a controller (e.g., the controller can receive user inputs as to temperature, duration, and timing of heat delivery). In some examples, the first heat device 2512(*a*) and/or the second heat device 2512(*b*) can be operable to provide heat at a temperature sufficient to melt the first string 2504 and/or the second string 2532. In some examples, the temperature can be about 245 degrees C. to about 265 degrees C., about 265 degrees C. to about 285 degrees C., about 285 degrees C. to about 305 degrees C., about 305 degrees C. to about 325 degrees C., about 345 degrees C. to about 365 degrees C., about 365 degrees C. to about 385 degrees C., or about 385 degrees C. to about 400 degrees C. In some examples, the temperature can depend on the material of the string to be melted. The temperature can be between the melting point and ignition point of the material of the string to be melted.

Figure 25E:
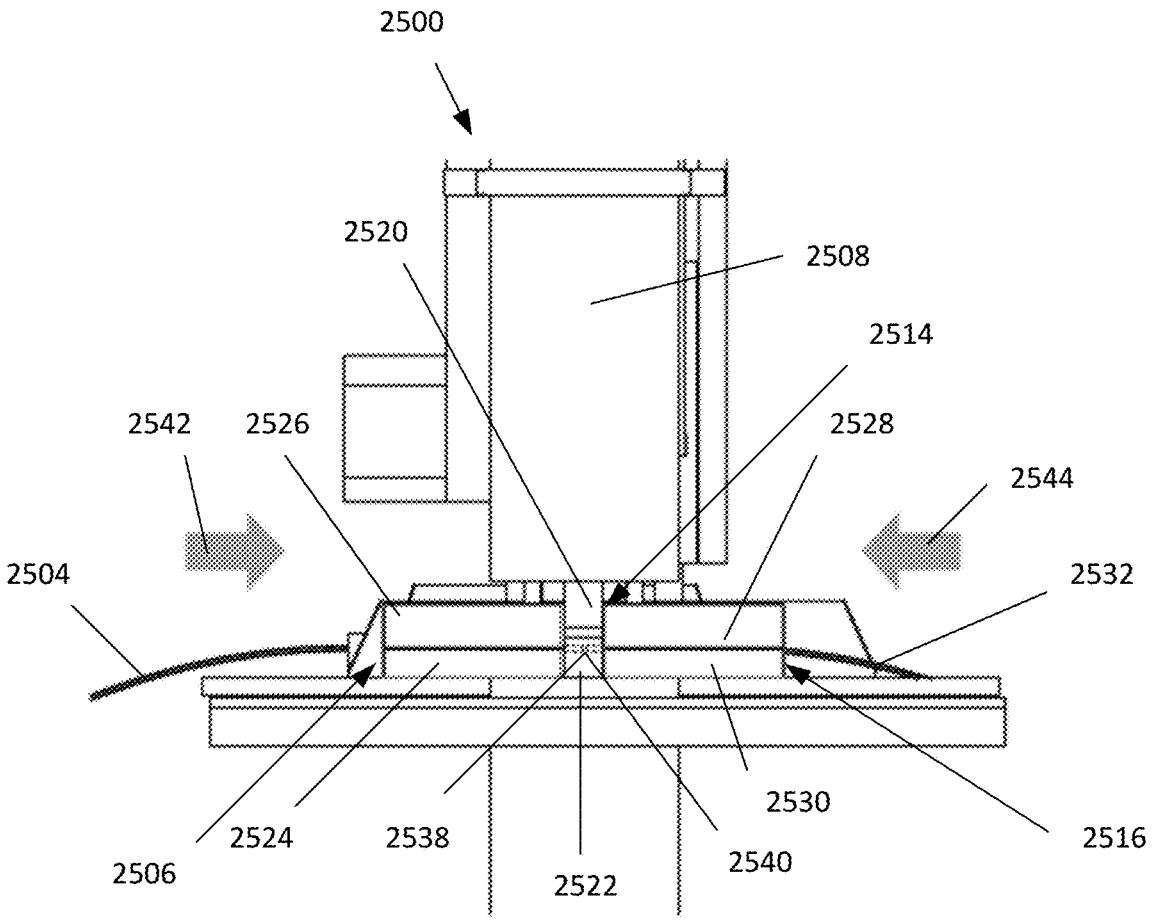
FIG. 25E illustrates a system for forming strings in a compression loading position in one example.

FIG. 25E illustrates a compression mechanism loading position of the system 2500. In the compression mechanism loading position, the end 2538 of the first string 2504 is loaded into the lower compression component 2522 of the compression mechanism 2514. The end 2538 can be loaded into the lower compression component 2522 of the compression mechanism 2514 by moving the first string holding mechanism 2506 towards the compression mechanism 2514. The first string holding mechanism 2506 can be longitudinally moveable throughout the system 2500 as described herein. Arrow 2542 illustrates the motion of the first string holding mechanism 2506 in the compression mechanism loading position.

In the compression mechanism loading position, the end 2540 of the second string 2532 is loaded into the lower compression component 2522 of the compression mechanism 2514. The end 2540 can be loaded into the lower compression component 2522 of the compression mechanism 2514 by moving the second string holding mechanism 2516 towards the compression mechanism 2514. The second string holding mechanism 2516 can be longitudinally moveable throughout the system 2500 as described herein. Arrow 2544 illustrates the motion of the second string holding mechanism 2516 in the compression mechanism loading position. In some examples, the end 2538 of the first string 2504 and the end 2540 of the second string 2532 are loaded into the lower compression component 2522, such that end 2538 contacts end 2540. In some examples, end 2538 and end 2540 are loaded in the lower compression component 2522 such that end 2538 and end 2540 overlap with one another.

Figure 25F:
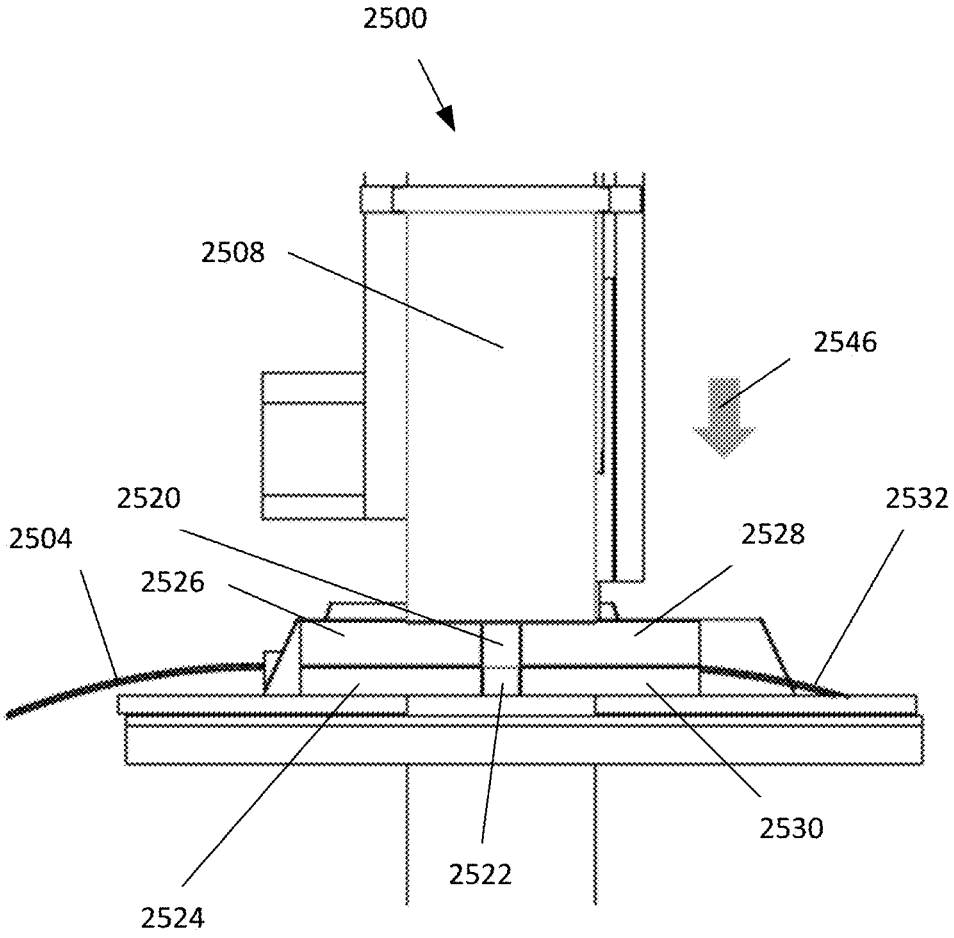
FIG. 25F illustrates a system for forming strings in a forming position in one example.

FIG. 25F illustrates a forming position of the system 2500. In the forming position, the upper compression component 2520 is driven downward towards the lower compression component 2522. The upper compression component 2520 can be coupled to a drive arm 2508. The drive arm 2508 can be operable to drive the upper compression component 2520 downward into contact with the lower compression component 2522, thereby providing a pressure or force to the ends 2538, 2540 of the first string 2504 and the second string 2532. Arrow 2546 illustrates the motion of the drive arm 2508 in the forming position. In some examples, when pressure or force provided by the upper compression component 2520 to the ends 2538, 2540 when the ends 2538, 2540 have been melted causes the ends 2538, 2540 to connect to one another. As described herein, the ends 2538, 2540 can be connected by the force or pressure such that the ends 2538, 2540 form a consistent and uniform diameter with the first string 2504 and second string 2532. In this manner, the first string 2504 and the second string 2532 are connected and have a uniform and consistent diameter. In some examples, the pressure or force provided by the upper compression component 2520 and the drive arm 2508 is controlled by the controller via a user input (e.g., user inputs the pressure or force to be applied).

In some examples, the system 2500 can further include one or more fans. The one or more fans can be operable to cool the ends 2538, 2540 of the first string 2504 and the second string 2532 after the ends 2538, 2540 have been connected. For example, the one or more fans can provide cool air to the ends 2538, 2540 thereby cooling the ends 2538, 2540.

Figure 24:
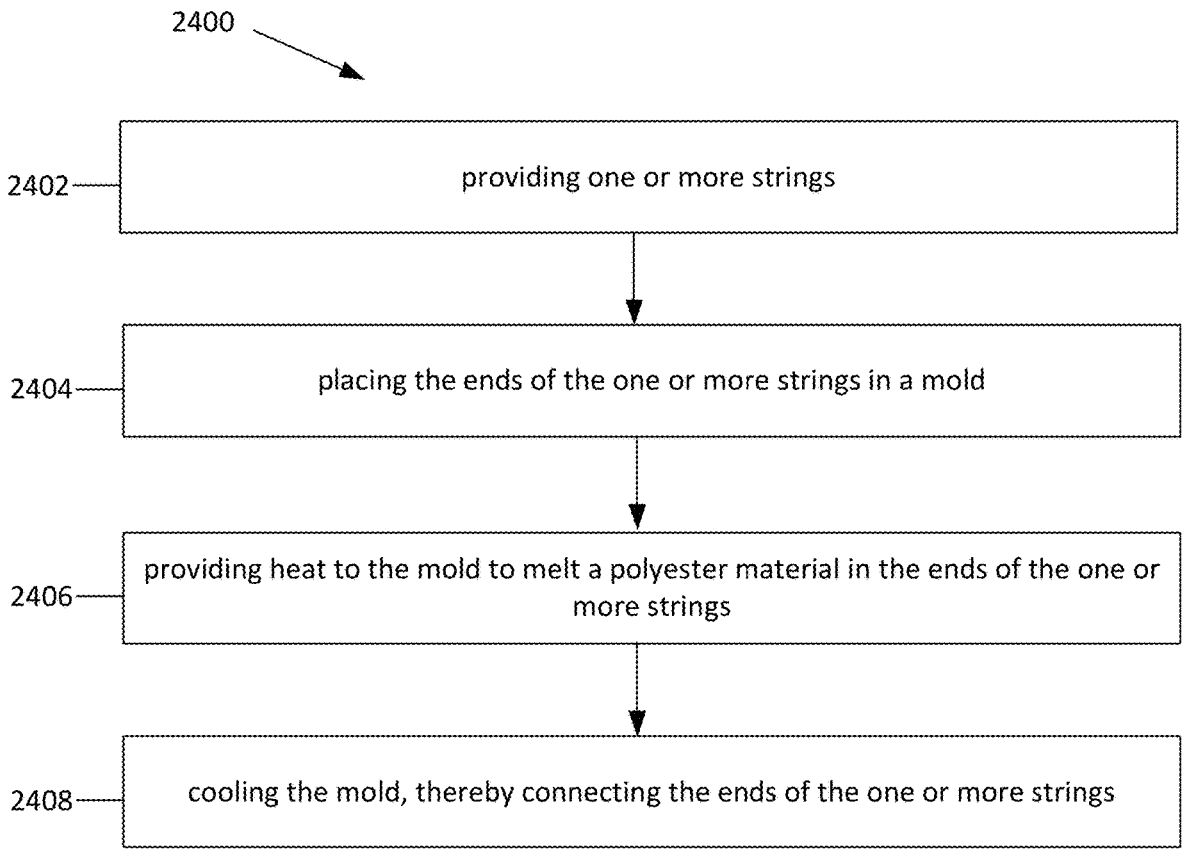
FIG. 24 is a flow chart of an exemplary method for producing a looped string in one example.

Further provided herein is a method for making a looped string. FIG. 24 illustrates the method 2400. The method 2400 can begin at block 2402. At block 2402, the method 2400 can include providing one or more strings. In some examples, the strings include a UV reactive material, such as a fluorescent dye, phosphorescent materials, or other UV reactive materials known in the art. In some examples, the one or more strings include 1, 2, 3, 4, 5, 6, 7, 8, 9, 10, or more strings. The strings can comprise a mixture of a cotton material and a polyester material.

At block 2404, the method 2400 includes placing the ends of the one or more strings in a mold. The mold can be configured to transfer heat to an interior of the mold, but the mold does not melt or otherwise change in shape. In some examples, only two ends are placed in a single heat resistant mold. Multiple molds can be provided to connect multiple strings. The mold can have a diameter of about 0.1 mm to about 1 mm, or about 0.5 mm to about 0.6 mm.

At block 2406, the method 2400 can include providing heat to the mold to melt a polyester material in the ends of the one or more strings. In some examples, the heat can be provided at a temperature of about 245° C. to about 265° C., about 265° C. to about 285° C., about 285° C. to about 305° C., about 305° C. to about 325° C., about 345° C. to about 365° C., about 365° C. to about 385° C., or about 385° C. to about 400° C.

At block 2408, the method 2400 can include cooling the mold. Cooling the mold allows the polyester ends of the string or strings to be permanently coupled together at a diameter as defined by the mold. In some examples, the diameter of the connected ends is the same or substantially the same as the diameter of the remainder of the string or strings. In some examples, the method 2400 can be repeated to connect multiple strings until a looped string comprising multiple strings is formed.

Figure 26:
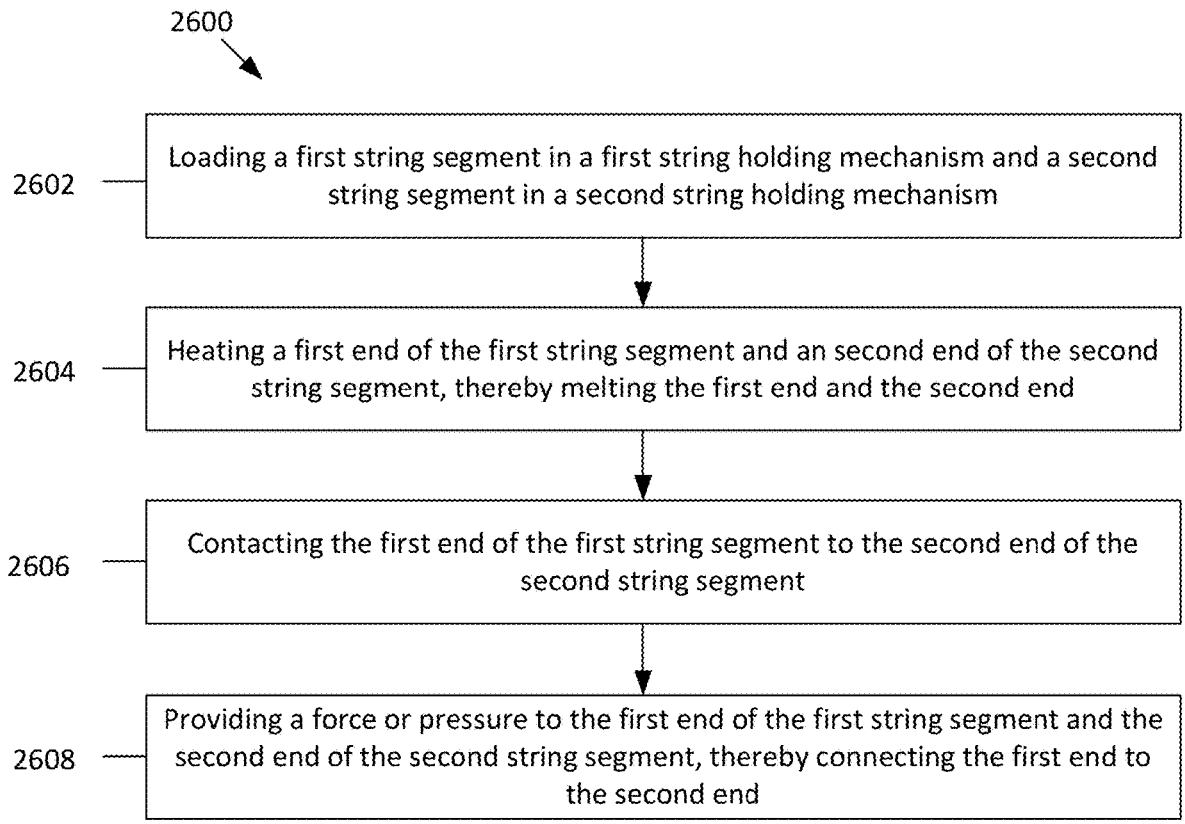
FIG. 26 is a flow chart of an exemplary method for producing a string in one example.

Further provided herein is a method 2600 for making the strings described herein. FIG. 26 illustrates the method 2600. In some examples, the method 2600 can be operable to form a continuous looped string that includes multiple segments of strings having different materials (e.g., different fluorophores, phosphors, and/or colors).

At block 2602, the method 2600 can begin by loading a first string segment in a first string holding mechanism and a second string segment in a second string holding mechanism. In some examples, a first end of the first string segment can extend longitudinally out of the first string holding mechanism and a second end of a second string segment can extend longitudinally out of the second string holding mechanism. In some examples, the method 2600 can include securing the first string segment to the first string holding mechanism such that the first string segment does not move in relation to the first string holding mechanism. In some examples, the first string holding mechanism can be a clamp or other mechanism operable to secure the first string segment. In some examples, the method 2600 can include securing the second string segment to the second string holding mechanism such that the second string segment does not move in relation to the second string holding mechanism. In some examples, the second string loading mechanism can be a clamp or other mechanism operable to secure the second string segment.

At block 2604, the method 2600 can include heating the first end of the first string segment and the second end of the second string segment, thereby melting the first end and the second end. In some examples, to heat the first end and the second end, the first string holding mechanism and the second string holding mechanism are translated longitudinally such that the first end and the second end align with at least one heat device. In some examples, the at least one heat device can be operable to provide heated air or gas to the first end and the second end. In some examples, the at least one heat device provides heat at a temperature sufficient to melt the first end and the second end. In some examples, the temperature can be about 245 degrees C. to about 265 degrees C., about 265 degrees C. to about 285 degrees C., about 285 degrees C. to about 305 degrees C., about 305 degrees C. to about 325 degrees C., about 345 degrees C. to about 365 degrees C., about 365 degrees C. to about 385 degrees C., or about 385 degrees C. to about 400 degrees C. In some examples, the temperature can depend on the material of the string to be melted. The temperature can be between the melting point and ignition point of the material of the string to be melted. In some examples, the at least one heat device can include a first heat device operable to heat the first end and a second heat device operable to heat the second end.

At block 2606, the method 2600 can include contacting the first end of the first string segment with the second end of the second string segment. Contacting the first end and the second end can include moving, translating, and/or sliding the first string holding mechanism and second string holding mechanism closer together. In some examples, the first end and the second end are contacted when loaded in a compression mechanism. In some examples, the compression mechanism can include a mold, channel, or other geometry operable to receive the first end and the second end. In some examples, the compression mechanism receives the first end and the second end in a mold, channel, or other geometry configured to form the first end and the second end into a connected string having the same or substantially the same diameter as the first string segment and the second string segment. In some examples, the compression mechanism can include an upper compression portion and a lower compression portion. The melted ends can be received in the lower compression portion. In some examples, the lower compression portion and the upper compression portion can each form a half of a mold or channel operable to connect the melted ends and form a diameter consistent with the first string segment and the second string segment.

At block 2608, the method 2600 can include providing a force or pressure to the first end of the first string segment and the second end of the second string segment, thereby connecting the first end to the second end. The force or pressure can be provided by the compression mechanism (e.g., the upper compression component can be moved downward to contact the lower compression component, thereby providing the force or pressure on the ends of the string segments). In some examples, the force or pressure both connects the melted first end and the melted second end and forms the melted first end and the melted second end into a desired diameter. For example, the melted first end and the melted second end can be formed into a diameter defined by a mold or channel. In some examples, the formed diameter of the first end and the second end is substantially equal to the diameter of the first string segment and the second string segment, thereby forming a continuous string with a consistent and uniform diameter.

In some examples, the method 2600 can include cooling the connected first end and second end. Cooling the connected first end and second end can include providing cool air via one or more fans or allowing the connected first end and second end to cool at room temperature.

In some examples, the method 2600 can be repeated multiple times to attach multiple segments of string together. In some examples, the method 2600 is completed when one end of a continuous string (including multiple segments) is connected to the opposite end of the continuous string, thereby forming a looped string.

Figure 27:
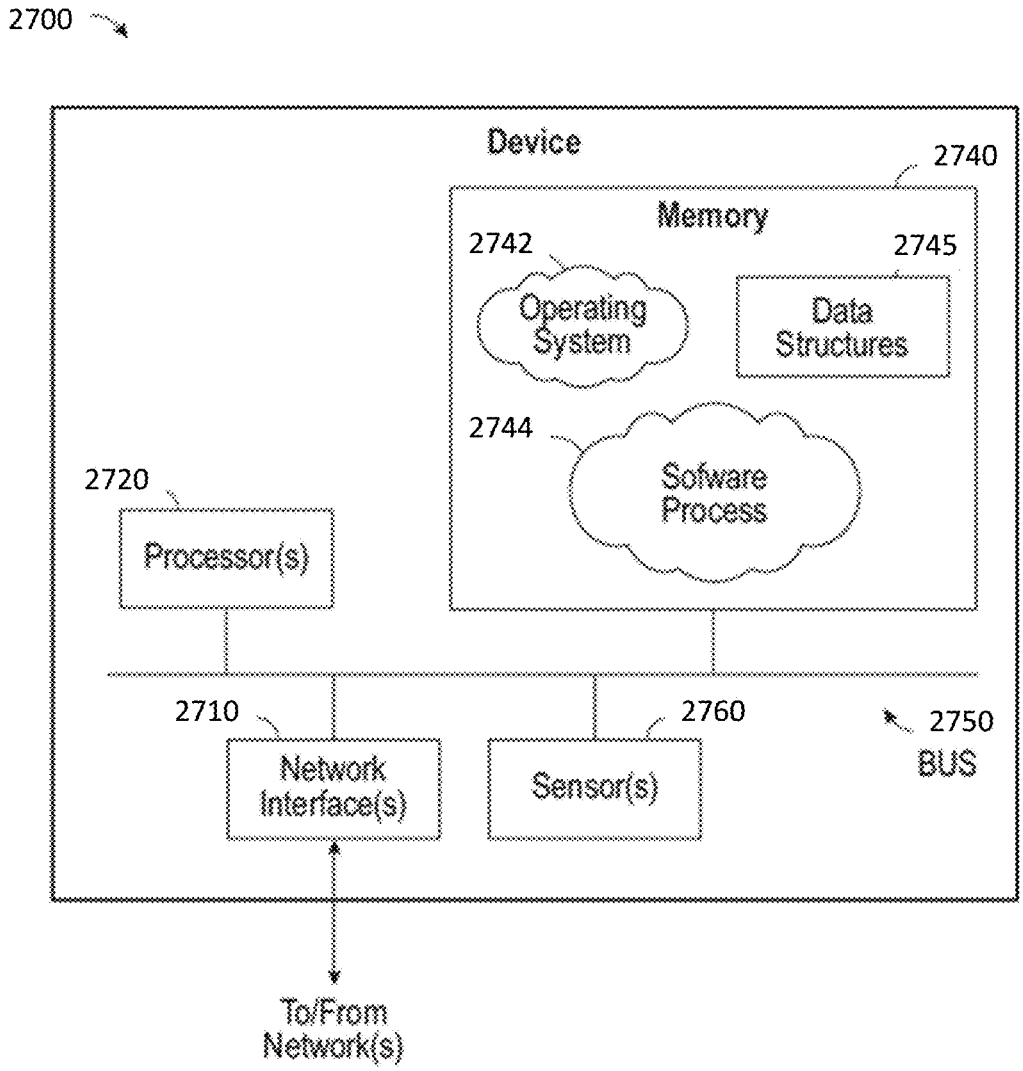
FIG. 27 is a block diagram of an exemplary controller in one example.

FIG. 27 is a block diagram of an exemplary controller 2700. In some examples, the device 100 can have one or more controllers 2700. In some examples, the system 2500 can have one or more controllers 2700. Controller 2700 is configured to perform processing of data and communicate with the sensors 2760 (e.g., load sensors in the device 100 and/or sensors in the system 2500 for maintaining pressure, temperature, etc.), motors for actuating components (e.g., first wheel 120(*a*) and second wheel 120(*b*) of the device and/or first string holding mechanism 2506 and second string holding mechanism 2516, drive arm 2508, etc.), buttons 112, 212, power switch 110, power wheel 210, first UV light source 118, second UV light source 242, the heat devices 2512(*a*), 2512(*b*), and other components described herein. In operation, controller 2700 communicates with one or more of the above-discussed components and may also be configured to communicate with remote devices/systems. It will be appreciated that an exemplary controller 2700 can be used with the device 100 and another exemplary controller 2700 can be used with the system 2500.

As shown, controller 2700 can include hardware and software components such as network interfaces 2710, at least one processor 2720, sensors 2760 (e.g., sensors for determining position of components, power delivered to motors, etc.) and a memory 2740 interconnected by a system bus 2750. Network interface(s) 2710 can include mechanical, electrical, and signaling circuitry for communicating data over communication links, which may include wired or wireless communication links. Network interfaces 2710 are configured to transmit and/or receive data using a variety of different communication protocols.

Processor 2720 represents a digital signal processor (e.g., a microprocessor, a microcontroller, or a fixed-logic processor, etc.) configured to execute instructions or logic to perform tasks for operation of the device 100 and/or the system 2500. Processor 2720 may include a general purpose processor, special-purpose processor (where software instructions are incorporated into the processor), a state machine, application specific integrated circuit (ASIC), a programmable gate array (PGA), an individual component, a distributed group of processors, and the like. Processor 2620 typically operates in conjunction with shared or dedicated hardware, including but not limited to, hardware capable of executing software and hardware. For example, processor 2720 may include elements or logic adapted to execute software programs and manipulate data structures 2745, which may reside in memory 2740.

Sensors 2760, which may include sensors for positioning and operation of various components disclosed herein, typically operate in conjunction with processor 2720 to perform measurements, and can include special-purpose processors, detectors, transmitters, receivers, and the like. In this fashion, sensors 2760 may include hardware/software for generating, transmitting, receiving, detection, logging, and/or sampling various parameters of the device 100 and/or system 2500.

Memory 2740 comprises a plurality of storage locations that are addressable by processor 2720 for storing software programs and data structures 2745 associated with the embodiments described herein. An operating system 2742, portions of which may be typically resident in memory 2740 and executed by processor 2720, functionally organizes the device by, inter alia, invoking operations in support of software processes and/or services 2744 executing on controller 2700. These software processes and/or services 2744 may perform processing of data and communication with controller 2700, as described herein. Note that while process/service 2644 is shown in centralized memory 2740, some examples provide for these processes/services to be operated in a distributed computing network.

It will be apparent to those skilled in the art that other processor and memory types, including various computer-readable media, may be used to store and execute program instructions pertaining to functions of the device 100 and/or system 2500 described herein. Also, while the description illustrates various processes, it is expressly contemplated that various processes may be embodied as modules having portions of the process/service 2744 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 2720 or computer readable medium encoded with instructions for execution by processor 2720 that, when executed by the processor 2720, are operable to cause the processor 2720 to perform the functions described herein.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

Numerous examples are provided herein to enhance understanding of the present disclosure. A specific set of statements are provided as follows.

Statement 1: A device for propelling a looped string through air, the device comprising: a handle; a head attached to a proximal end of the handle; at least one motor housed within the head; two driven wheels operable to be driven by the at least one motor, the two driven wheels rotatably mounted to the head, the two driven wheels comprising a gap operable to receive a portion of the looped string; a detachable cover operable to cover at least a portion of the two driven wheels; and at least one UV light source operable to provide UV light at a wavelength of about 315 nm to about 380 nm.

Statement 2: The device according to Statement 1, wherein the at least one UV light source comprises a first UV light source and a second UV light source, the first UV light source being located on an exterior surface of the head and the second UV light source located on the head within the detachable cover.

Statement 3: The device according to Statement 2, wherein the second UV light source is configured to provide UV light to a portion of the looped string inside of the detachable cover and the first UV light source is configured to provide UV light to a portion of the looped string outside of the detachable cover.

Statement 4: The device according to Statement 3, the device further comprising a light button having four modes, the four modes comprising an off mode, a first UV light source on mode, a second UV light source on mode, and a first UV light source and second UV light source on mode.

Statement 5: The device according to any one of preceding Statements 1 to 4, wherein the detachable cover has a plurality of vents.

Statement 6: The device according to Statement 5, wherein the two driven wheels each have a plurality of fan blades extending radially from a cap towards a circumference of each wheel, the plurality of fan blades operable to draw air into the detachable cover through the plurality of vents thereby cooling the device.

Statement 7: The device according to any of preceding Statements 1 to 6, wherein the head comprises: an upper U-shaped projection; a lower U-shaped projection; and one or more head attachment mechanisms operable to couple to one or more detachable cover attachment mechanisms; wherein the upper U-shaped projection and the lower U-shaped projection are operable to align with the gap between the two driven wheels and receive the looped string.

Statement 8: The device according to Statement 7, wherein the one or more head attachment mechanisms comprise one or more magnets and the one or more detachable cover attachment mechanisms comprise one or more magnets.

Statement 9: The device according to any one of preceding Statements 1 to 8, further comprising a light filter operable to narrow a bandwidth of the at least one UV light source.

Statement 10: The device according to any one of preceding Statements 1 to 9, wherein the detachable cover comprises a translucent material.

Statement 11: The device according to any one of preceding Statements 1 to 10, wherein the detachable cover comprises a UV reactive material, the UV reactive material operable to illuminate when provided light by the at least one UV light source.

Statement 12: The device according to any one of preceding Statements 1 to 11, wherein the at least one UV light source emits light that is invisible to a human eye.

Statement 13: The device according to any one of preceding Statements 1 to 12, further comprising: a rechargeable battery housed within the handle or the head, the rechargeable battery electrically coupled to the at least one motor and operable to provide power to the at least one motor; and a charging port operable to electrically connect to a power source, the charging port located on an exterior surface of the head or the handle.

Statement 14: The device according to any one of preceding Statements 1 to 13, wherein the head further comprises a plurality of vents on a side opposite the detachable cover.

Statement 15: The device according to any one of preceding Statements 1 to 14, the device further comprising one or more heat sinks coupled to the at least one UV light source and/or the at least one motor.

Statement 16: A device for propelling a looped string through air, the device comprising: a handle; a head attached to an end of the handle, the head comprising: an upper U-shaped projection; a lower U-shaped projection; and one or more head attachment mechanisms; at least one motor housed within the head; a rechargeable battery in electric communication with the at least one motor; two driven wheels operable to be driven by the at least one motor and rotatably mounted to the head, each of the two driven wheels comprising a plurality of fan blades extending radially from a cap toward a circumference of each of the two driven wheels, wherein the two driven wheels define a gap operable to receive the looped string; a detachable cover operable to cover at least a portion of the two driven wheels, the detachable cover comprising: a translucent material comprising a UV reactive material; one or more detachable cover attachment mechanisms operable to couple to the one or more head attachment mechanisms; and a plurality of vents operable to allow air to enter into the detachable cover; a first UV light operable to provide UV light at a wavelength of about 315 nm to about 390 nm, the first UV light located on the head within the detachable cover; and a second UV light operable to provide UV light at a wavelength of about 315 nm to about 390 nm, the second UV light located on an exterior surface of the head.

Statement 17: The device according to Statement 16, the device further comprising: a controller in communication with the at least one motor; and at least one sensor operable to determine a load on the at least one motor, wherein the controller is configured to shut off the at least one motor if the load exceeds a threshold.

Statement 18: A looped string, the looped string comprising: a first string having a first end and a second end; and a second string having a first end and a second end, wherein the first end of the first string is permanently coupled to the first end of the second string, wherein the second end of the first string is permanently coupled to the second end of the second string, wherein the first string and the second string comprise a polyester material and a cotton material, wherein the polyester materials of the first string and the second string are heated at the first ends and the second ends thereby permanently coupling the first ends and the second ends at a connection point, wherein the first string comprises a first fluorescent dye and the second string comprises a second fluorescent dye.

Statement 19: The looped string according to Statement 18, further comprising one or more additional strings coupled to the first string and/or the second string to form the looped string.

Statement 20: The looped string according to Statement 18 or 19, wherein the first fluorescent dye and the second fluorescent dye illuminate in different colors when provided an excitation light.

Statement 21: The looped string according to any of preceding Statements 18 to 20, wherein the connection point has substantially the same diameter as the looped string.

Statement 22: A system for attaching a first end of a first string to a second end of a second string, the system comprising: a first string holding mechanism; a second string holding mechanism; and a compression mechanism located between the first string holding mechanism and the second string holding mechanism.

Statement 23: The system according to Statement 22, wherein the first string holding mechanism is operable to secure the first string such that the first end of the first string extends outward from the first string holding mechanism in a direction towards the compression mechanism.

Statement 24: The system according to Statement 22 or 23, wherein the second string holding mechanism is operable to secure the second string such that the second end of the second string extends outward from the second string holding mechanism in a direction towards the compression mechanism.

Statement 25: The system according to any one of preceding Statements 22 to 24, wherein the compression mechanism comprises is operable to provide heat to the first end and the second end.

Statement 26: The system according to any one of preceding Statements 22 to 25, the system further comprising at least one heat device located between the first string holding mechanism and the second string holding mechanism.

Statement 27: The system according to Statement 26, wherein the at least one heat device is operable to provide heat to the first end and the second end, thereby melting the first end and the second end.

Statement 28: The system according to Statement 27, wherein first string holding mechanism and the second string holding mechanism are operable to move toward each other such that the first end and the second end are in contact.

Statement 29: The system according to Statement 28, wherein the compression mechanism is operable to provide a force or pressure to the first end and the second such that the first end and the second end are connected.

Statement 30: The system according to any of preceding Statements 22 to 30, wherein the compression mechanism comprises a mold or channel operable to form the first end and the second end into a desired diameter when the first end and second end are melted and provided a pressure or force.

Statement 31: The system according to Statement 30, wherein the desired diameter is a diameter substantially equal to the diameter of the first string and/or second string.

What is claimed is:

1. A device for propelling a looped string, the device comprising:

a head including a cover;

at least one wheel rotatably mounted to the head, the at least one wheel operable to propel the looped string when one or more of the at least one wheel is rotated by a motor; and a light source operable to emit a light;

wherein at least a portion of the cover is translucent and/or transparent, wherein the light causes a first portion of the looped string to illuminate a first color and a second portion of the looped string to illuminate a second color which illuminates the at least a portion of the cover with the first color when the first portion passes within the at least a portion of the cover and the second color when the second portion passes within the at least a portion of the cover.

2. The device of claim 1, wherein the cover illuminates with the same color as the looped string.

3. The device of claim 1, wherein the looped string comprises one or more fluorescent materials.

4. The device of claim 1, wherein the cover reflects a color of the looped string.

5. The device of claim 1, wherein the cover glows with a color of the looped string.

6. The device of claim 1, wherein the cover includes a pattern operable to illuminate when provided an excitation light.

7. The device of claim 1, wherein the at least one wheel is operable to propel the looped string in a continuous motion, wherein a portion of the looped string passes within the cover and a portion of the looped string is propelled outside the cover.

8. The device of claim 7, wherein the looped string comprises two or more string portions, wherein each of the two or more string portions illuminates in a different color.

9. The device of claim 7, wherein a color of the cover changes as different portions of the looped string pass by the cover.

10. The device of claim 1, wherein the cover is removably coupled with the head.

11. The device of claim 1, wherein the cover includes one or more vents.

12. A device for propelling a looped string, the device comprising:

a head including a cover;

at least one wheel disposed on the head, the at least one wheel, rotated by a motor, is operable to propel the looped string, wherein at least a portion of the at least one wheel is covered by the cover;

a light source operable to emit a light which causes a first portion of the looped string to illuminate a first color and a second portion of the looped string to illuminate a second color;

wherein at least a portion of the cover is translucent and/or transparent, wherein the cover is operable to illuminate in the first color when the first portion of the looped string passes within the cover and the second color when the second portion of the looped string passes within the cover.

13. The device of claim 12, wherein the looped string comprises two or more string portions, wherein each of the two or more string portions illuminates in a different color when exposed to the light.

14. The device of claim 13, wherein a color of the cover changes as different portions of the looped string pass through the cover.

15. A kit for propelling a looped string, the kit comprising:

a looped string including a first portion and a second portion; and a device for propelling the looped string, the device comprising:

a head including a cover having at least a translucent and/or transparent portion; and at least one wheel rotatably mounted to the head, the at least one wheel, rotated by a motor, is operable to propel the looped string; and a light source operable to emit a light which causes the first portion of the looped string to illuminate a first color and the second portion of the looped string to illuminate a second color, wherein the looped string, when exposed to the light, is operable to illuminate with one or more colors so that the cover illuminates in the first color when the first portion of the looped string passes within the cover and the second color when the second portion of the looped string passes within the cover.

16. The kit of claim 15, wherein the cover is operable to illuminate with the one or more colors of the at least one looped string.

17. The kit of claim 15, wherein the first portion has different UV reactive characteristics than the second portion.

* * * * *